US009230699B2

(12) United States Patent
Ishida et al.

(10) Patent No.: US 9,230,699 B2
(45) Date of Patent: Jan. 5, 2016

(54) METHOD OF CHEMICAL DECONTAMINATION FOR CARBON STEEL MEMBER OF NUCLEAR POWER PLANT

(71) Applicant: Hitachi-GE Nuclear Energy, Ltd., Hitachi-shi, Ibaraki (JP)

(72) Inventors: Kazushige Ishida, Tokyo (JP); Hideyuki Hosokawa, Tokyo (JP); Motohiro Aizawa, Hitachi (JP)

(73) Assignee: Hitachi-GE Nuclear Energy, Ltd., Hitachi-shi (JP)

( * ) Notice: Subject to any disclaimer, the term of this patent is extended or adjusted under 35 U.S.C. 154(b) by 171 days.

(21) Appl. No.: 14/450,886

(22) Filed: Aug. 4, 2014

(65) Prior Publication Data

US 2015/0073198 A1 Mar. 12, 2015

(30) Foreign Application Priority Data

Sep. 6, 2013 (JP) ..... 2013-185070

(51) Int. Cl.

| | |
|---|---|
| ***G21F 9/16*** | (2006.01) |
| ***G21F 9/00*** | (2006.01) |
| ***G21F 9/30*** | (2006.01) |

(52) U.S. Cl.
CPC . *G21F 9/004* (2013.01); *G21F 9/30* (2013.01)

(58) Field of Classification Search
CPC ..... G21F 9/16; G21F 9/00; A62D 3/36
USPC ..... 588/18, 1, 318, 412
See application file for complete search history.

(56) References Cited

U.S. PATENT DOCUMENTS

| | | | |
|---|---|---|---|
| 6,335,475 | B1 | 1/2002 | Nagase et al. |
| 6,549,603 | B1 | 4/2003 | Ishida et al. |
| 6,921,515 | B2 | 7/2005 | Nagase et al. |
| 6,973,154 | B2 | 12/2005 | Nagase et al. |
| 7,087,120 | B1 | 8/2006 | Enda et al. |
| 2004/0152940 | A1 | 8/2004 | Ishida et al. |
| 2008/0075886 | A1 | 3/2008 | Nagase et al. |

FOREIGN PATENT DOCUMENTS

| | | | |
|---|---|---|---|
| JP | 62-250189 | A | 10/1987 |
| JP | 2000-105295 | A | 4/2000 |
| JP | 2001-74887 | A | 3/2001 |
| JP | 2002-333498 | A | 11/2002 |
| JP | 2003-33653 | A | 2/2003 |
| JP | 2003-90897 | A | 3/2003 |
| JP | 2004-170278 | A | 6/2004 |
| JP | 2004-286471 | A | 10/2004 |
| JP | 2009-109427 | A | 5/2009 |
| WO | WO 94/11884 | | 5/1994 |

OTHER PUBLICATIONS

Extended European Search Report issued in counterpart of European Application No. 14179671.4 dated Jul. 31, 2015 (Nine (9) pages).

*Primary Examiner* — Edward Johnson

(74) *Attorney, Agent, or Firm* — Crowell & Moring LLP

(57) ABSTRACT

A circulation pipe of a chemical decontamination apparatus including a malonic acid injection apparatus and an oxalic acid injection apparatus is connected to a purification system pipe, which is made of carbon steel, of a boiling water nuclear power plant. A malonic acid aqueous solution is injected from the malonic acid injection apparatus into the circulation pipe. An oxalic acid aqueous solution is injected from the oxalic acid injection apparatus into the circulation pipe. A reduction decontaminating solution including a malonic acid of 5200 ppm and an oxalic acid within a range of 50 to 400 ppm is supplied into the purification system pipe through the circulation pipe. Reduction decontamination for an inner surface of the purification system pipe is executed. After the reduction decontamination for the purification system pipe finishes, the malonic acid and oxalic acid included in the solution are decomposed and furthermore, the solution is purified.

14 Claims, 12 Drawing Sheets

METHOD OF CHEMICAL DECONTAMINATION FOR CARBON STEEL MEMBER OF NUCLEAR POWER PLANT

CLAIM OF PRIORITY

The present application claims priority from Japanese Patent application serial no. 2013-185070, filed on Sep. 6, 2013, the content of which is hereby incorporated by reference into this application.

BACKGROUND OF THE INVENTION

1. Technical Field

The present invention relates to a method of chemical decontamination for carbon steel member of a nuclear power plant and more particularly to a method of chemical decontamination for carbon steel member of a nuclear power plant suitable for application to carbon steel member of a boiling water nuclear power plant.

2. Background Art

For example, the boiling water nuclear power plant (hereinafter referred to as BWR plant) includes a reactor having a core disposed in a reactor pressure vessel (referred to as RPV). Reactor water (cooling water) supplied to the core by a recirculation pump (or an internal pump) is heated by heat generated due to nuclear fission of a nuclear fuel material in a fuel assembly loaded in the core and is partially turned to steam. The steam is introduced from the RPV to a turbine to rotate the turbine. The steam discharged from the turbine is condensed by a condenser to water. The water is supplied to the RPV as feed water. Metallic impurities are mainly removed from the feed water by a demineralizer installed in a water feed pipe so as to suppress generation of a radioactive corrosion product in the RPV. The reactor water is cooling water existing in the RPV.

Further, a corrosion product which is a base of the radioactive corrosion product is generated on a surface of a structure member of a BWR plant such as an RPV and primary loop recirculation system piping (referred to as recirculation system pipe), the surface coming into contact with the reactor water, so that stainless steel and a nickel based alloy of less corrosion are used for the main primary-system structure members. Further, overlay welding of stainless steel exists on an inner surface of the RPV made of low alloy steel, thus the low alloy steel is prevented from direct contact with the reactor water. Furthermore, part of the reactor water is cleaned up by a demineralizer of a reactor water clean-up system, thus metallic impurities slightly existing in the reactor water is removed positively.

However, even if such a corrosion countermeasure as mentioned above is taken, very little metallic impurities unavoidably exist in the reactor water, so some metallic impurities, as a metallic oxide, are adhered to the surface of each fuel rod included in a fuel assembly. The impurities (for example, a metallic element) deposited on the surface of each fuel rod cause a nuclear reaction by irradiation of neutrons discharged by nuclear fission of the nuclear fuel in each fuel rod and become radioactive nuclides such as cobalt 60, cobalt 58, chromium 51, and manganese 54.

These radioactive nuclides are mostly kept to be adhered to the surface of each fuel rod in a form of an oxide. However, some radioactive nuclides are eluted as ions into the reactor water depending of the solubility of the taken-in oxide and are re-discharged into the reactor water as an insoluble called a crud. The radioactive material included in the reactor water is removed by the reactor water clean-up system communicated with the RPV. The radioactive material not removed by the reactor water clean-up system is accumulated on the surface of the structure member (for example, pipe) of the nuclear power plant which comes into contact with the reactor water while circulating in the re-circulation system together with the reactor water. As a result, a radiation is discharged from the surface of the structure member, causing radiation exposure to an operator during the periodic inspection operation.

The exposure dose of the operator is controlled so as not to exceed the regulated value for each operator. The regulated value has been reduced in recent years and there is the need to decrease the exposure dose for each operator as much as possible.

Therefore, when the exposure dose during the periodic inspection operation is expected to be high, the chemical decontamination for dissolving and removing the radioactive nuclide deposited on the pipe is executed. For example, Japanese Patent Laid-open No. 2000-105295 proposes a chemical decontamination method of executing reduction decontamination using an aqueous solution (a reduction decontaminating solution) including an oxalic acid and hydrazine, decomposition of the oxalic acid and hydrazine, and oxidation decontamination using an aqueous solution (an oxidation decontaminating solution) including a potassium permanganate. The chemical decontamination method is executed for the pipe and the like of the nuclear power plant.

Japanese Patent Laid-open No. 2001-74887 describes a chemical decontamination method executed to a recirculation system pipe made of stainless steel which is connected to the RPV and a purification system pipe made of carbon steel member of the reactor water clean-up system which is connected to the recirculation system pipe. In the chemical decontamination method, a potassium permanganate aqueous solution is supplied into the recirculation pipe and the purification system pipe to execute the oxidation decontamination for the inner surfaces of those pipes. Thereafter, an aqueous solution including the oxalic acid and hydrazine is supplied to the recirculation system pipe and the purification system pipe to execute the reduction decontamination. After the reduction decontamination, the oxalic acid and hydrazine included in the aqueous solution are decomposed.

Further, Japanese Patent Laid-open No. 2004-286471 and Japanese Patent Laid-open No. 2004-170278 describe a chemical decontamination method of storing the decontamination objects such as the equipment made of stainless steel and pipe which are removed from the nuclear power plant in a decontamination bath and executing the chemical decontamination. In the chemical decontamination method, a mixed aqueous solution including a formic acid of a concentration ratio of 0.9 and an oxalic acid of a concentration ratio of 0.1 is supplied into the decontamination bath to decontaminate the decontamination objects and the reduction decontamination of the decontamination objects is executed in the decontamination bath by using the mixed aqueous solution. After completion of the reduction decontamination, hydrogen peroxide (or ozone) is supplied into the mixed solution and the formic acid and oxalic acid included in the mixed aqueous solution are decomposed by the hydrogen peroxide (or ozone).

Japanese Patent Laid-open No. 2002-333498 describes a chemical decontamination method. In the chemical decontamination method, the chemical decontamination, concretely, reduction decontamination of carbon steel member using an aqueous solution (a reduction decontamination aqueous solution) including an organic acid (for example, the formic acid) and hydrogen peroxide is executed. Furthermore, in the chemical decontamination method described in Japanese Patent Laid-open No. 2003-90897, the reduction decontamination for the carbon steel member is executed using the oxalic acid aqueous solution, and after the reduction decontamination, an acid aqueous solution (for example, a formic acid aqueous solution) is brought into contact with the carbon steel member. Therefore, at the time of the reduction decontamination using the oxalic acid aqueous solution, the ferrous oxalate generated on the surface of the carbon steel member is removed by action of the acid aqueous solution.

Japanese Patent Laid-open No. 62-250189 describes a chemical decontamination method of executing the reduction decontamination for equipment made of stainless steel of a primary cooling system device by using a solution including a malonic acid, the oxalic acid, and hydrazine.

CITATION LIST

Patent Literature

[Patent Literature 1] Japanese Patent Laid-open No. 2000-105295

[Patent Literature 2] Japanese Patent Laid-open No. 2001-74887

[Patent Literature 3] Japanese Patent Laid-open No. 2004-286471

[Patent Literature 4] Japanese Patent Laid-open No. 2004-170278

[Patent Literature 5] Japanese Patent Laid-open No. 2002-333498

[Patent Literature 6] Japanese Patent Laid-open No. 2003-90897

[Patent Literature 7] Japanese Patent Laid-open No. 62(1987)-250189

SUMMARY OF THE INVENTION

Technical Problem

In the reduction decontamination using the oxalic acid aqueous solution aiming at a stainless steel member, the iron concentration in the oxalic acid aqueous solution does not rise so as to deposit ferrous oxalate. However, as described in Japanese Patent Laid-open No. 2001-74887, when executing the reduction decontamination for the carbon steel member (for example, the purification system pipe of the reactor water clean-up system) using the oxalic acid aqueous solution, if the ratio of the carbon steel member to the oxalic acid aqueous solution rises, the iron concentration in the oxalic acid aqueous solution rises and ferrous ions eluted in the oxalic acid aqueous solution due to dissolution of magnetite which is a base metal of the carbon steel member and an oxide film, reacts the oxalic acid to form a complex and the complex, that is, ferrous oxalate is deposited on the surface of the carbon steel member in contact with the oxalic acid aqueous solution.

The ferrous oxalate is low in solubility, so that it deposits on the surface of the carbon steel member which is a main generation source of ferrous ions. When the ferrous oxalate is deposited on the oxide film formed on the surface of the carbon steel member, the dissolution of the oxide film by the oxalic acid aqueous solution is hindered at the time of reduction decontamination. As a result, the dissolution of the radioactive nuclide included in the oxide film is suppressed and the efficiency of the chemical decontamination for the carbon steel member is reduced.

In Japanese Patent Laid-open No. 2002-333498, an aqueous solution including an organic acid (for example, a formic acid) and hydrogen peroxide is used to improve the solubility of the oxide film formed on the surface of the carbon steel member. To remove the ferrous ions eluted in the aqueous solution by the dissolution of the oxide film and cations of the radioactive nuclide, the aqueous solution including the organic acid, hydrogen peroxide, and ferrous ions needs to be supplied to a cation exchange resin column filled with a cation exchange resin. However, the hydrogen peroxide deteriorates the cation exchange resin in the cation exchange resin column, so that the aqueous solution including the eluted ferrous ions, eluted cations of the radioactive nuclide, organic acid, and hydrogen peroxide cannot be supplied to the cation exchange resin column, and the concentrations of the ferrous ions and cations of the radioactive nuclide cannot be lowered. As a result, the chemical decontamination efficiency for the carbon steel member is reduced.

In the chemical decontamination method described in Japanese Patent Laid-open No. 2003-90897, after the oxalic acid included in the oxalic acid aqueous solution is decomposed, the ferrous oxalate deposited on the surface of the carbon steel member in the reduction decontamination of the carbon steel member is dissolved by using the oxalic acid aqueous solution using the formic acid aqueous solution. However, since the ferrous oxalate is deposited on the oxide film on the surface of the carbon steel member while the reduction decontamination for the carbon steel member using the oxalic acid aqueous solution is executed, the dissolution of the oxide film due to the oxalic acid aqueous solution is suppressed. Further, the chemical decontamination method described in Japanese Patent Laid-open No. 2003-90897 executes the ferrous oxalate decomposition process using a formic acid aqueous solution after the reduction decontamination process for the carbon steel member using the oxalic acid aqueous solution. Thus, in the chemical decontamination method described in Japanese Patent Laid-open No. 2003-90897, the time required for the chemical decontamination for the carbon steel member becomes longer.

An object of the present invention is to provide a chemical decontamination method for the carbon steel member of the nuclear power plant capable of further improving efficiency of reduction decontamination for the carbon steel member.

Solution to Problem

A feature of the present invention for attaining the above object is a chemical decontamination method comprising steps of bringing a reduction decontaminating solution including a malonic acid and an oxalic acid within a range from 50 to 400 ppm into contact with a surface of a carbon steel member of a nuclear power plant; and executing reduction decontamination for the surface of the carbon steel member by the reduction decontaminating solution.

The film of a ferrous oxide formed on the surface of the carbon steel member is dissolved by the oxalic acid, and the base metal of the carbon steel member is dissolved by the malonic acid. As a consequence, the ferrous oxide, and the radioactive nuclides included in the base metal of the carbon steel member are eluted into the reduction decontaminating solution. The oxalic acid concentration included in the reduction decontaminating solution is within the range from 0 ppm to 400 ppm, so that the deposition of the ferrous oxalate onto the ferrous oxide film formed on the surface of the carbon steel member is suppressed and the dissolution of the ferrous oxide film by the oxalic acid can be performed efficiently. Since the dissolution of the ferrous oxide film can be performed efficiently, the dissolution of the portion including the radioactive nuclide of the base metal of the carbon steel member also can be performed efficiently by the malonic acid. Therefore, the reduction decontamination efficiency for the carbon steel member can be further improved.

The above object can be accomplished even by bringing a reduction decontaminating solution including the malonic acid and oxalic acid with oxygen gas injected into contact with the surface of the carbon steel member of the nuclear power plant and performing the reduction decontamination by the reduction decontaminating solution for the surface of the carbon steel member.

Advantageous Effect of the Invention

According to the present invention, the reduction decontamination effects for the carbon steel member can be further improved.

DETAILED DESCRIPTION OF THE PREFERRED EMBODIMENTS

The inventors variously investigated a method of being able to furthermore improve efficiency of reduction decontamination for a carbon steel member and as a result, have come to recognize that the suppression of deposition of the ferrous oxalate and the continuous removal of the ferrous ions eluted into the reduction decontaminating solution by the reduction decontamination and cations of the radioactive nuclide need to be accomplished at the time of the reduction decontamination for the carbon steel member. And, the inventors found a method of chemical decontamination for the carbon steel member capable of accomplishing them. The investigation contents performed by the inventors and the obtained results will be explained below.

Figure 4:
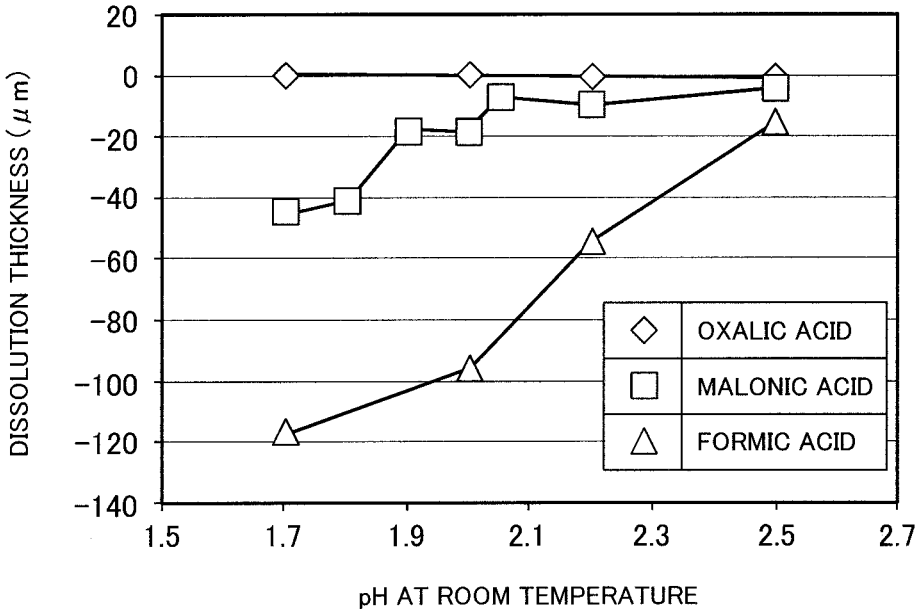
FIG. 4 is a characteristic diagram showing changes in dissolution thickness of test specimens made of carbon steel for pH of respective aqueous solutions of oxalic acid, formic acid, and malonic acid which are reduction decontamination agents.

The inventors, firstly, conducted a test of confirming the effects of the reduction decontamination which is a kind of chemical decontamination for test specimens made of carbon steel using an aqueous solution (reduction decontaminating solution) of chemical decontamination agent, concretely, the respective aqueous solutions of the oxalic acid, formic acid, and malonic acid. In this test, the oxalic acid aqueous solution, formic acid aqueous solution, and malonic acid aqueous solution were filled in different beakers and a test specimen made of carbon steel was separately immersed in the aqueous solution at 90° C. in each of the beakers for 6 hours. In this way, the reduction decontamination for each test specimen by each aqueous solution was performed. The results obtained by this test are shown in FIG. 4. FIG. 4 shows the changes in the dissolution thickness of the test specimens for the change in the pH of each of the aqueous solutions.

The dissolution thickness of the test specimens made of carbon steel member depends on the aqueous solution with each test specimen immersed and the result of (the formic acid aqueous solution)>(the malonic acid aqueous solution)>(the oxalic acid aqueous solution) was obtained from the test results shown in FIG. 4. The dissolution thickness of the test specimens immersed in the formic acid aqueous solution was largest and the dissolution thickness of the test specimens immersed in the oxalic acid aqueous solution was smallest. The test specimens immersed in the oxalic acid aqueous solution were dissolved little. Further, yellow deposits seen as ferrous oxalate were adhered to the surface of each test specimen immersed in the oxalic acid aqueous solution.

In the reduction decontamination for the test specimens using the malonic acid aqueous solution, when the pH of the aqueous solution was within the range from 1.7 (the malonic acid concentration of the malonic acid aqueous solution: 19000 ppm) to 2.0 (the malonic acid concentration: 5200 ppm), the test specimens made carbon steel was able to be dissolved. Furthermore, if the pH of the malonic acid aqueous solution becomes 1.8 (the malonic acid concentration: 12000 ppm) or lower, the dissolution of the test specimens made of carbon steel increases more quickly than a case of the pH of 1.9 (the malonic acid concentration: 7800 ppm) or higher.

Furthermore, the test of confirming the solubility of the hematite ($\alpha$-$Fe_2O_3$) and the magnetite ($Fe_3O_4$) which are ferrous oxides was conducted using the oxalic acid aqueous solution, the formic acid aqueous solution, and the malonic acid aqueous solution. In this test, the oxalic acid aqueous solution, the formic acid aqueous solution, and the malonic acid aqueous solution of 300 ml each were filled in different beakers and the temperature of each aqueous solution was kept at 90° C. The pH of each aqueous solution is 2.0. The hematite which is a ferrous oxide was immersed for 6 hours in the aqueous solution filled in each beaker and the solubility of the hematite by each aqueous solution was confirmed. And, the magnetite which is a different ferrous oxide was immersed in each aqueous solution filled in different beakers under the same condition as the hematite and the solubility of the magnetite by the respective aqueous solutions was confirmed.

Figure 5:
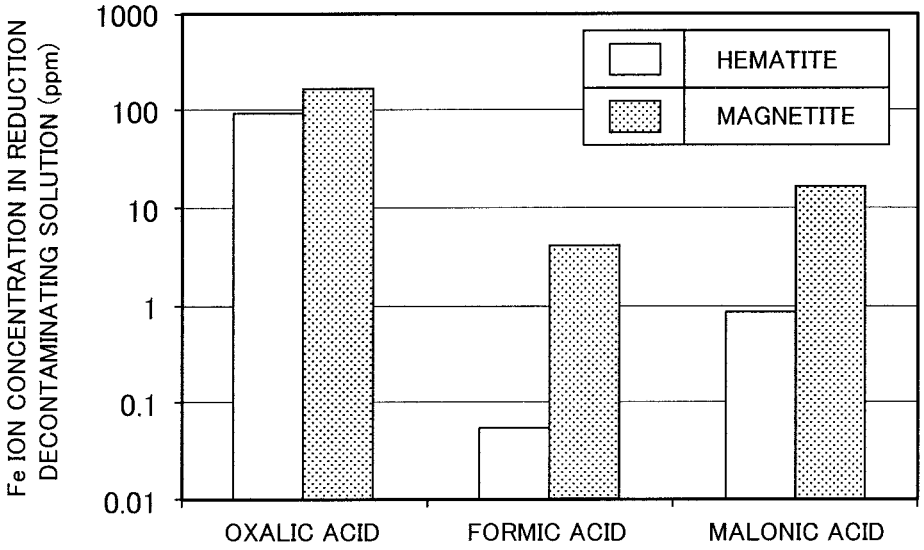
FIG. 5 is an explanatory drawing showing dissolution amount of hematite ($\alpha$-$Fe_2O_3$) and magnetite ($Fe_3O_4$) when respective aqueous solutions of oxalic acid, formic acid, and malonic acid are used.

The results obtained by this test are shown in FIG. 5. FIG. 5 shows the solubility of the hematite and magnetite by the ferrous ion concentration in the oxalic acid aqueous solution, the formic acid aqueous solution, and the malonic acid aqueous solution which are a reduction decontaminating solution. It shows that the respective solubility of the hematite and magnetite increases as the ferrous ion concentration increases. The solubility of the hematite and magnetite became (the oxalic acid aqueous solution)>(the malonic acid aqueous solution)>(the formic acid aqueous solution) and the solubility of the hematite and magnetite by the oxalic acid aqueous solution became highest. Further, the formic acid aqueous solution could hardly dissolve the hematite.

According to the above test results, it is found that the malonic acid is preferable for the dissolution of the carbon steel member and ferrous oxide. Further, if a very small quantity of oxalic acid is added to the malonic acid aqueous solution, the dissolution of the ferrous oxide which is an oxide film formed on the surface of the carbon steel member can be improved with the dissolution rate of the carbon steel member kept.

The inventors conducted the test of confirming the dissolution of the carbon steel member by the aqueous solution including the malonic acid and oxalic acid which was generated by adding the oxalic acid to the malonic acid aqueous solution. The oxalic acid concentration was changed from 0 ppm to 1200 ppm in the malonic acid aqueous solution with a malonic acid concentration of 5200 ppm, and the malonic acid aqueous solutions with a different oxalic acid concentration were filled in different beakers in a predetermined volume, and the temperature of each malonic acid aqueous solution was held at 90° C. The test specimens made of carbon steel were immersed in the malonic acid aqueous solution with a different oxalic acid concentration in each beaker for 6 hours, and the reduction decontamination was performed for each test specimen. In this test, no oxygen gas was injected into the malonic acid aqueous solution in each beaker.

Figure 6:
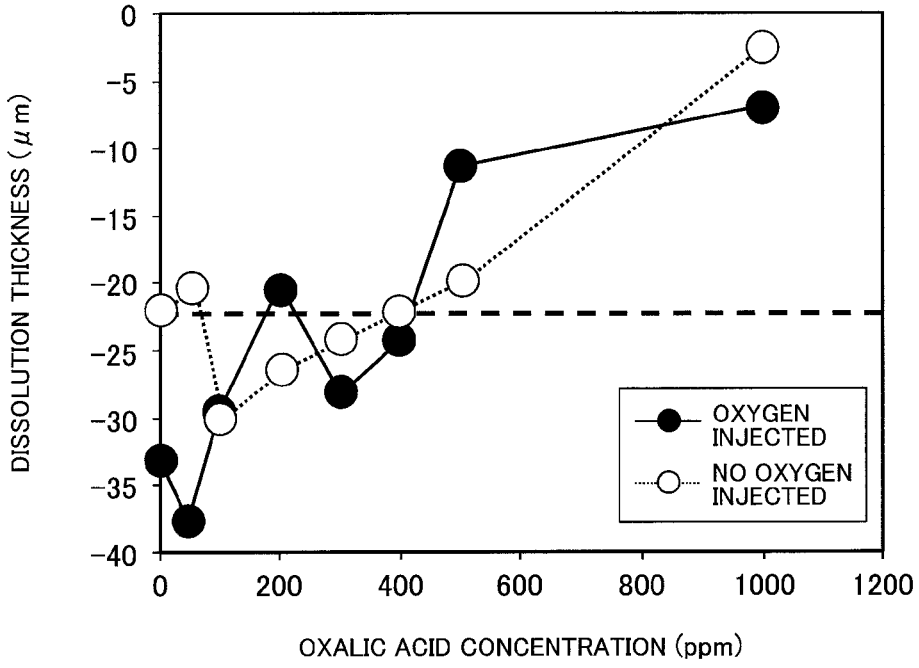
FIG. 6 is a characteristic diagram showing changes in dissolution thickness of test specimens made of carbon steel for changes in oxalic acid concentration of an aqueous solution including malonic acid and oxalic acid.

The results obtained by this test are shown by ○ marks (no oxygen is injected into the malonic acid aqueous solution) in FIG. 6. Further, in FIG. 6, the test results obtained by immersing the test specimens made of carbon steel in the malonic acid aqueous solutions of a different oxalic acid concentration with oxygen gas injected are also shown by ● marks. The conditions of the test using the malonic acid aqueous solutions of a different oxalic acid concentration with oxygen gas injected are the same as the conditions of the test using the malonic acid aqueous solutions of a different oxalic acid concentration with no oxygen gas injected.

When the oxalic acid concentration of the malonic acid aqueous solution was within a range from 50 to 400 ppm, the dissolution thickness of each test specimen made of carbon steel became larger than the dissolution thickness of each test specimen made of carbon steel by the malonic acid aqueous solution with no oxalic acid added. On the other hand, if the oxalic acid concentration of the malonic acid aqueous solution became 500 ppm or higher, the dissolution thickness of each test specimen made of carbon steel became smaller than the dissolution thickness of the test specimen made of carbon steel by the malonic acid aqueous solution including no oxalic acid. Further, when oxygen gas was injected into the malonic acid aqueous solutions with a different oxalic acid concentration, the dissolution thickness of each test specimen made of carbon steel was increased than the case that no oxygen gas was injected into the malonic acid aqueous solution including the oxalic acid within the range of the oxalic acid concentration from 50 to 400 ppm.

Figure 7:
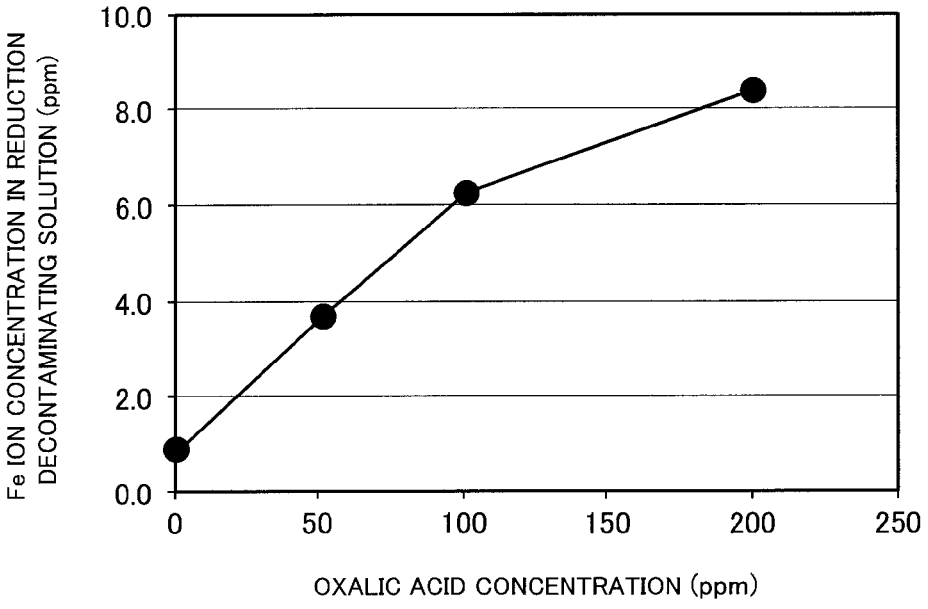
FIG. 7 is a characteristic diagram showing changes in dissolution amount of ferrous oxide for changes in oxalic acid concentration in an aqueous solution including the malonic acid and oxalic acid.

The inventors, furthermore, conducted the test of confirming the dissolution of the ferrous oxide using the malonic acid aqueous solution with the oxalic acid concentration changed within a range from 0 to 200 ppm. The malonic acid concentration of the malonic acid aqueous solution (reduction decontaminating solution) used in this test is 5200 ppm. The oxalic acid concentration in the malonic acid aqueous solution with a malonic acid concentration of 5200 ppm was changed at the four stages of 0 ppm, 50 ppm, 100 ppm, and 200 ppm within the range from 0 to 200 ppm. As mentioned above, four kinds of malonic acid aqueous solutions with a different oxalic acid concentration were filled in different beakers in volume of 300 ml each and the temperature of the malonic acid aqueous solution in each beaker was held at 90° C. The ferrous oxide (for example, the hematite or magnetite) was immersed in the malonic acid aqueous solution in each beaker for 6 hours. The obtained test results are shown in FIG. 7. Based on the test results shown in FIG. 7, it is found that the ferrous ion concentration increases, that is, the solubility of the ferrous oxide increases as the oxalic acid concentration of the malonic acid aqueous solution increases.

Figure 8:
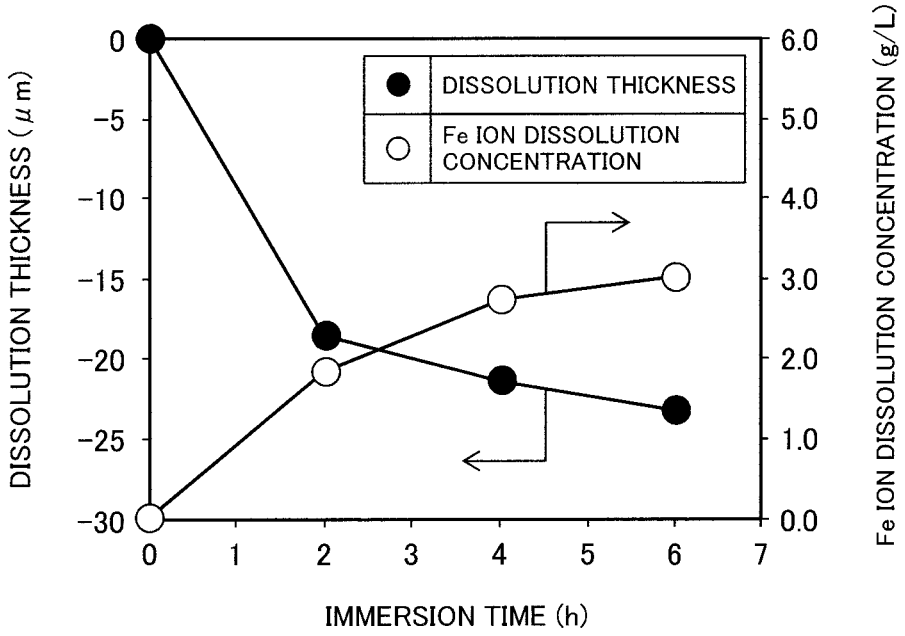
FIG. 8 is a characteristic diagram showing changes with time in dissolution thickness of test specimens made of carbon steel immersed in an aqueous solution including the malonic acid and oxalic acid.

The inventors conducted the test of confirming the change with time of the dissolution thickness of each test specimens made of carbon steel when the reduction decontamination was performed by the aqueous solution including the malonic acid and oxalic acid. The results obtained by this test are shown in FIG. 8. In FIG. 8, the changes in the ferrous ion concentration in the aqueous solution (reduction decontaminating solution) including the malonic acid and oxalic acid are also shown together with the change with time of the dissolution thickness of each test specimen. If the ferrous ion concentration in the reduction decontaminating solution enters the saturation state, the dissolution thickness of each test specimens made of carbon steel is apt to be saturated as well.

A ferrous dissolution rate dM/dt from the carbon steel member which is a test specimen is expressed by Formula (1) based on an Fe ion concentration $C_{bulk}$ in the bulk water, an Fe ion concentration $C_s$ on the surface of the carbon steel member, and a ferrous dissolution rate k from the carbon steel member. Namely, if the Fe ion concentration $C_{bulk}$ in the bulk water increases, the ferrous dissolution rate k from the carbon steel member is reduced.

$$dM/dt=k\times(C_{bulk}-C_s) \quad (1)$$

Therefore, the removal of ferrous ions from the reduction decontaminating solution is necessary to increase the solubility of the carbon steel member.

The inventors conducted the test of investigating the effect on the dissolution of the carbon steel member by the temperature of the aqueous solution including the malonic acid and oxalic acid. In this test, the malonic acid aqueous solution (no oxalic acid is included) with a malonic acid concentration of 5200 ppm and the aqueous solution including the malonic acid of 5200 ppm and the oxalic acid of 100 ppm were filled separately in beakers, and the test specimens made of carbon steel were separately immersed in the aqueous solutions in the respective beakers. And, the temperature of each aqueous solution was changed within the range from 60° C. to 90° C. and the dissolution thickness of each test specimen immersed in each aqueous solution was measured under each temperature condition. Further, when a certain aqueous solution is boiled, the radioactive nuclide dissolved in the aqueous solution may be scattered in correspondence with the generated steam, so that the temperature of the aqueous solution is held at lower than the boiling point.

Figure 9:
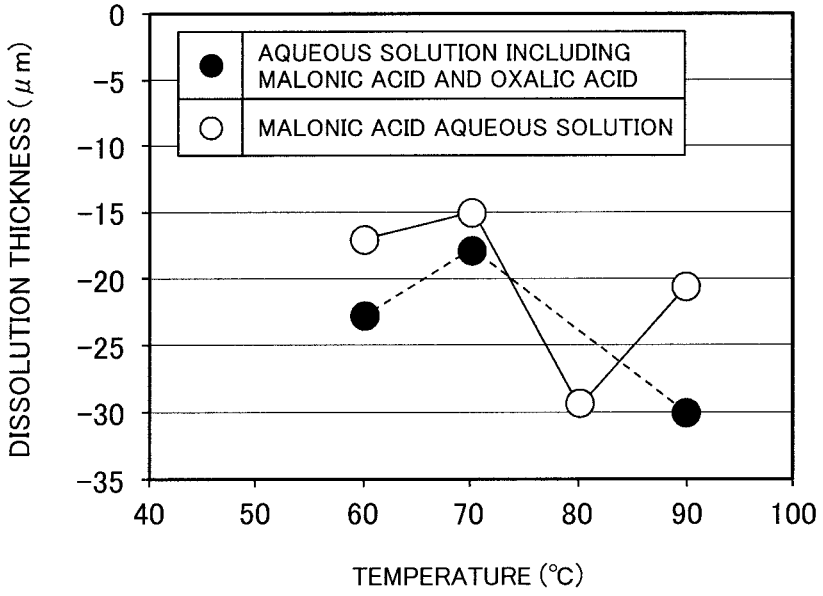
FIG. 9 is a characteristic diagram showing changes in dissolution thickness of test specimens made of carbon steel for temperature of an aqueous solution including malonic acid and oxalic acid.

The results obtained in this test are shown in FIG. 9. Based on the test results shown in FIG. 9, it is found that if the temperature of the aqueous solution including the malonic acid and oxalic acid is kept at 60° C. or higher, the carbon steel member can be dissolved. Particularly, if the temperature of the aqueous solution including the malonic acid and oxalic acid is increased to 80° C. or higher, the solubility of the carbon steel member is increased.

Based on the above test results, a first proposal of realizing the suppression of deposition of the ferrous oxalate and the continuous removal of the ferrous ions and cations of the radioactive nuclide eluted into the reduction decontaminating solution by the reduction decontamination and furthermore improving efficiency of the reduction decontamination for the carbon steel member is to execute the reduction decontamination for the carbon steel member using the aqueous solution (reduction decontaminating solution) including the malonic acid and oxalic acid with an oxalic acid concentration existing within the range from 50 to 400 ppm. By performing the reduction decontamination for the carbon steel member using such a solution, it is possible to improve the solubility of the ferrous oxide formed on the surface of the carbon steel member in contact with the reduction decontaminating solution for the carbon steel member with the solubility of the carbon steel member by the malonic acid kept and also improve the efficiency of the reduction decontamination for the carbon steel member further. The malonic acid concentration of the reduction decontaminating solution including the malonic acid and oxalic acid with the oxalic acid concentration existing within the range from 50 to 400 ppm is desirably set within the range from 2100 to 19000 ppm. The malonic acid concentration of the aforementioned reduction decontaminating solution is desirably set within a range from 2100 to 7800 ppm from the viewpoint of suppressing damage of the equipment and pipes used in the nuclear power plant in common. On the other hand, in the aforementioned reduction decontaminating solution (the solution including the malonic acid and oxalic acid with the oxalic acid concentration existing within the range from 50 to 400 ppm) used in the reduction decontamination for the equipment and pipes (carbon steel member) made of carbon steel which are removed due to replace in the nuclear power plant and become wastes, the malonic acid concentration is desirably set within a range from 12300 to 19000 ppm. The temperature of the reduction decontaminating solution during the reduction decontamination is desirably set within a range from 60° C. to the temperature at the boiling point of the reduction decontaminating solution, preferably within a range from 80° C. to the temperature at the boiling point.

A second proposal of realizing the suppression of deposition of the ferrous oxalate and the continuous removal of the ferrous ions and cations of the radioactive nuclide eluted into the reduction decontaminating solution by the reduction decontamination and furthermore improving the efficiency of the reduction decontamination for the carbon steel member is to execute the reduction decontamination for the carbon steel member using the aqueous solution including the malonic acid and oxalic acid with oxygen gas supplied. By performing the reduction decontamination for the carbon steel member using such an aqueous solution, it is possible to improve the solubility of the ferrous oxide formed on the surface of the carbon steel member in contact with the reduction decontaminating solution for the carbon steel member with the solubility of the carbon steel member by the malonic acid kept and also improve the efficiency of the reduction decontamination for the carbon steel member further.

The embodiments of the present invention in which the aforementioned investigation results are reflected will be explained below.

Embodiment 1

Figure 1:
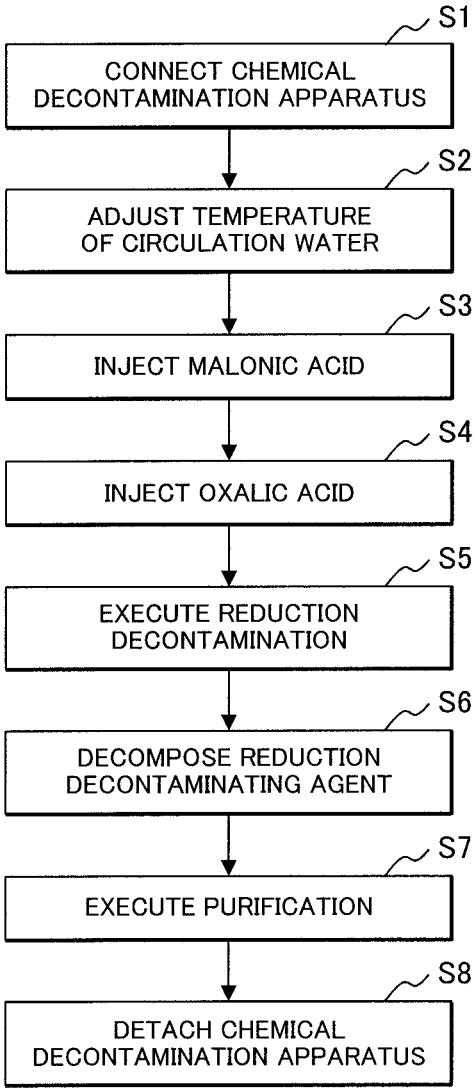
FIG. 1 is a flow chart showing processing procedure of a method of chemical decontamination for a carbon steel member of a nuclear power plant according to embodiment 1 which is a preferred embodiment of the present invention.
Figure 2:
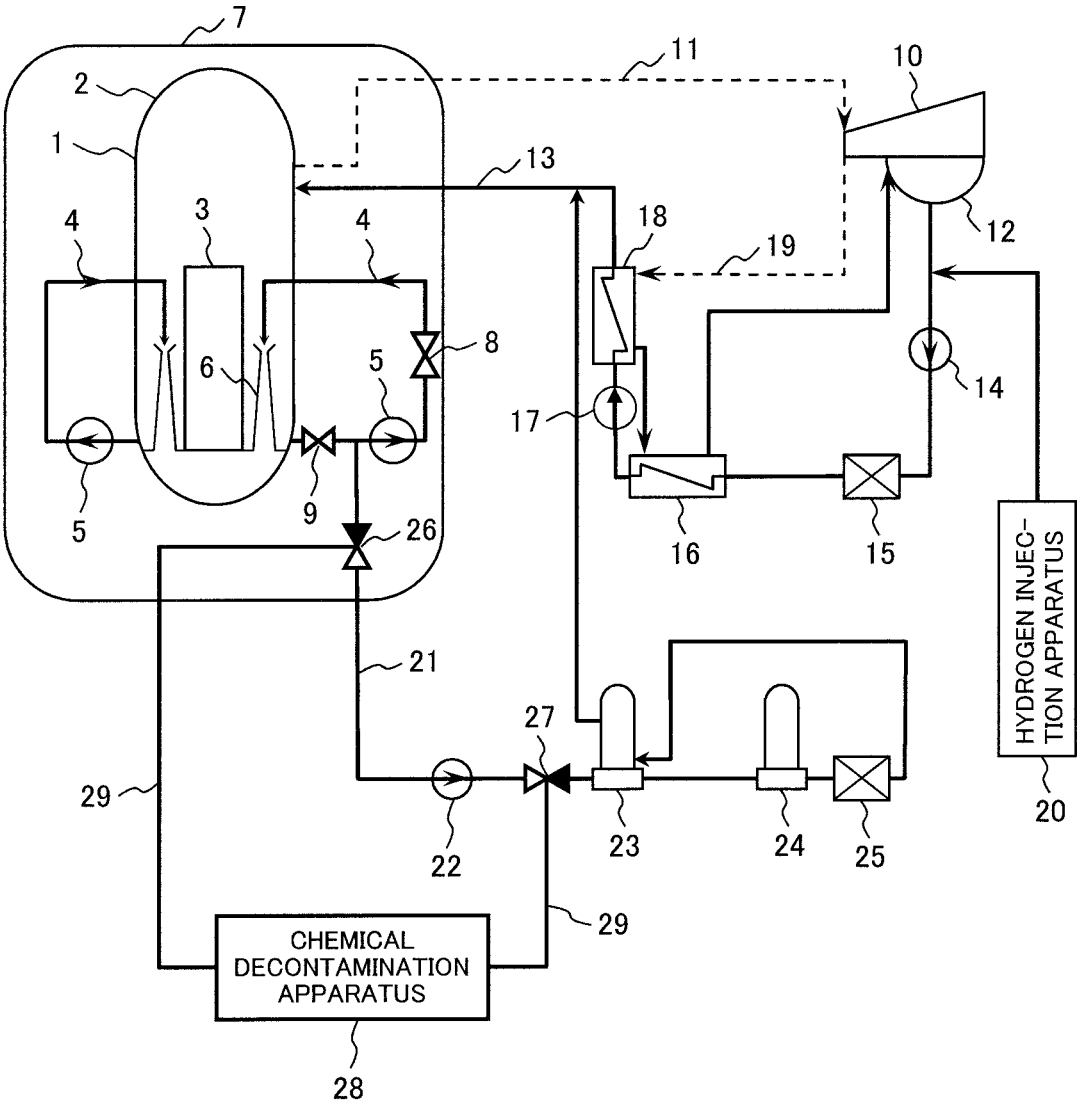
FIG. 2 is an explanatory drawing showing a connection state of a chemical decontamination apparatus to a boiling water nuclear power plant at execution time of a method of chemical decontamination for a carbon steel member of a nuclear power plant according to embodiment 1.
Figure 3:
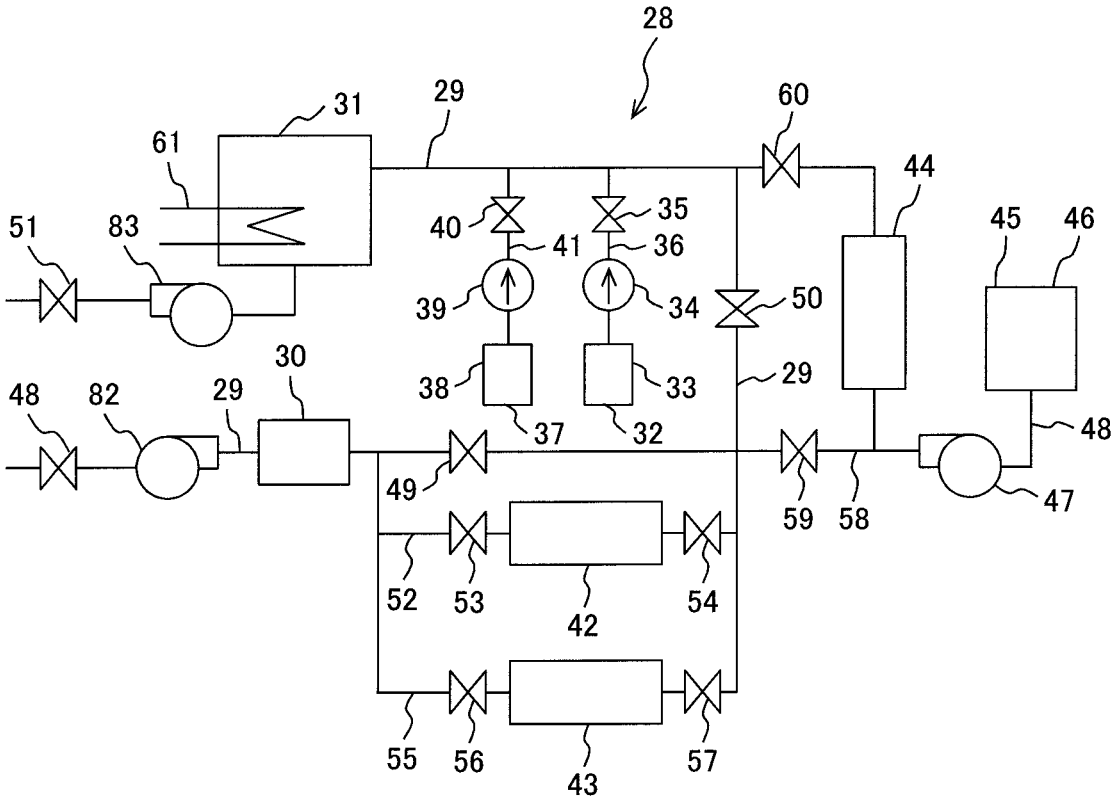
FIG. 3 is a detailed structural diagram showing a chemical decontamination apparatus shown in FIG. 2.

A method of chemical decontamination for a carbon steel member of a nuclear power plant according to embodiment 1 which is a preferred embodiment of the present invention will be explained by referring to FIGS. 1, 2, and 3. The method of chemical decontamination for a carbon steel member of a nuclear power plant according to the present embodiment is an example applied to a pipe (for example, the purification system pipe) of the boiling water nuclear power plant (hereinafter referred to as BWR plant), the pipe being made of carbon steel. This pipe is a carbon steel member.

A general structure of the BWR plant to which the method of chemical decontamination for a carbon steel member of a nuclear power plant according to the present embodiment is applied will be explained by referring to FIG. 2. The BWR plant is provided with a reactor 1, a turbine 10, a condenser 12, a primary loop recirculation system, a reactor water clean-up system, and a water feed system. The reactor 1 installed in a reactor primary containment vessel 7 includes a reactor pressure vessel (hereinafter referred to as RPV) 2 having a core 3 disposed in the RPV 2. Jet pumps 6 are installed in the RPV 2. A plurality of fuel assemblies (not shown) are loaded in the core 3. Each fuel assembly includes a plurality of fuel rods filled with a plurality of fuel pellets manufactured with a nuclear fuel material. Several primary loop recirculation systems include a recirculation pump 5 and a primary loop recirculation system piping (referred to as recirculation system pipe) 4 made of stainless steel, respectively and the recirculation pump 5 is installed on the recirculation system pipe 4. In the recirculation system pipe 4, a valve 9 is installed on the upstream side of the recirculation pump 5 and a valve 8 is installed on the downstream side of the recirculation pump 5. Particularly, the valve 9 is installed on the upstream side of a connection point of the recirculation system pipe 4 to a purification system pipe 21. The water feed system has a structure that a condensate pump 14, a condensate purification apparatus 15, a low-pressure feed water heater 16, a water feed pump 17, and a high-pressure feed water heater 18 are installed on a water feed pipe 13 connecting the condenser 12 to the RPV 2 in this order from the condenser 12 toward the RPV 2. A hydrogen injection apparatus 20 is connected to the water feed pipe 13 on the upstream side of the condensate pump 14. The reactor water clean-up system is structured so that a purification system pump 22, a regeneration heat exchanger 23, a non-regeneration heat exchanger 24, and a reactor water purification apparatus 25 are installed on the purification system pipe 21 connecting the recirculation system pipe 4 and the water feed pipe 13 in this order from the upstream side toward the downstream side. The purification system pipe 21 is connected to the recirculation system pipe 4 on the upstream side of the recirculation pump 5.

Cooling water (hereinafter referred to as reactor water) in the RPV 2 is pressurized by the recirculation pump 5 and is jetted into a bell mouth (not shown) of the jet pump 6 from a nozzle (not shown) of the jet pump 6 through the recirculation system pipe 4. The reactor water existing around the nozzle is sucked into the bell mouth by the action of the jetted water jetted from the nozzle. The reactor water discharged from the jet pump 6 is supplied to the core 3 and is heated by heat generated due to nuclear fission of a nuclear fuel material in the fuel rods. Part of the heated reactor water is turned steam. The steam is discharged into a main steam pipe 11 from the RPV 2, is introduced to the turbine 10 through the main steam pipe 11, and rotates the turbine 10. A generator (not shown) connected to the turbine 10 is also rotated and generates power. The steam discharged from the turbine 10 is condensed to water by the condenser 12.

This water is supplied into the RPV 2 through the water feed pipe 13 as feed water. The feed water flowing through the water feed pipe 13 is pressurized by the condensate pump 14, and impurities including in the feed water are moved by the condensate purification apparatus 15. The feed water is further pressurized by the water feed pump 17 and is heated by the low-pressure feed water heater 16 and the high-pressure feed water heater 18. The extraction steam extracted from the main steam pipe 11 and the turbine 10 by the extraction pipe 19 is supplied to the low-pressure feed water heater 16 and the high-pressure feed water heater 18 as a heating source for the feed water flowing through the water feed pipe 13.

The reactor water in the RPV 2 is subjected to irradiation of a radiation generated in correspondence to nuclear fission of a nuclear fuel material included in each fuel assembly loaded in the core 3, thereby causes radiolysis, and generates an oxidizing agent such as hydrogen peroxide and oxygen. The electrochemical corrosion potential of the structure member of the BWR plant which makes contact with the reactor water rises by the oxidizing agent. Therefore, in the BWR plant, hydrogen is injected into the feed water flowing in the water feed pipe 13 from the hydrogen injection apparatus 20. The hydrogen included in the feed water is injected into the reactor water in the RPV 2. The hydrogen and the oxidizing agent such as the hydrogen peroxide and oxygen included in the reactor water are reacted on each other, thus the oxidizing agent concentration of the reactor water is reduced and the electrochemical corrosion potential of the structure member of the BWR plant is lowered.

In the BWR plant mentioned above, since the BWR plant is shut down in order to exchange the fuel assemblies loaded in the core 3, the chemical decontamination for the purification system pipe 21 which is a carbon steel member is executed after the operation of the BWR plant is stopped. The chemical decontamination is performed in the state that one end portion of a circulation pipe 29 of a chemical decontamination apparatus 28 is connected to a valve 26 installed on the purification system pipe 21 and the other end portion of the circulation pipe 29 is connected to a valve 27 installed on the purification system pipe 21. A recirculation system pipe 4 side of the valve 26 is closed by a closed plug (not shown) so as to prevent the chemical decontaminating solution from flowing, and a regeneration heat exchanger 23 side of the valve 27 is also closed by another closed plug (not shown).

The detailed structure of the chemical decontamination apparatus 28 will be explained by referring to FIG. 3. The chemical decontamination apparatus 28 is provided with the circulation pipe (the chemical decontaminating solution pipe) 29, a cooling apparatus 30, a surge tank 31, a malonic acid injection apparatus 32, an oxalic acid injection apparatus 37, a cation exchange resin column 42, a mix bed ion exchange resin column 43, a decomposition apparatus 44, an oxidation agent supply apparatus 45, and circulation pumps 82 and 83. An open/close valve 48, the circulation pump 82, the cooler 30, valves 49 and 50, the surge tank 31, the circulation pump 83, and an open/close valve 51 are installed on the circulation pipe 29 in this order from the upstream side. A valve 53, the cation exchange resin column 42 with the cation exchange resin filled, and a valve 54 are installed on a pipe 52 with both ends connected to a circulation pipe 29 for bypassing the valve 49. A heater 61 is installed in the surge tank 31. A valve 56, the mix bed ion exchange resin column 43 with the cation exchange resin and anion exchange resin filled, and a valve 57 are installed on a pipe 55 with both ends connected to the pipe 52 for bypassing the valve 53, the cation exchange resin column 42, and the valve 54.

A valve 59, the decomposition apparatus 44, and a valve 60 are installed on a pipe 58 for bypassing the valve 50 and both ends of the pipe 58 is connected to the circulation pipe 29. The decomposition apparatus 44 is internally filled with, for example, ruthenium catalyst supported on an activated carbon surface.

The oxidation agent supply apparatus 45 includes a chemical tank 46 filled with an oxidation agent (for example, hydrogen peroxide), a feed pump 47, and an oxidation agent feed pipe 48. The chemical tank 46 is connected to the pipe 58 between the valve 59 and the decomposition apparatus 44 by the oxidation agent feed pipe 48 on which the feed pump 47 is installed.

The malonic acid injection apparatus 32 and the oxalic acid injection apparatus 37 are connected to the circulation pipe 29 between the valve 50 and the surge tank 31. The malonic acid injection apparatus 32 includes a chemical tank 33, an injection pump 34, and an injection pipe 36. The chemical tank 33 is connected to the circulation pipe 29 by the injection pipe 36 having the injection pump 34 and a valve 35. The chemical tank 45 is filled with the malonic acid aqueous solution.

The oxalic acid injection apparatus 37 includes a chemical tank 38, an injection pump 39, and an injection pipe 41. The chemical tank 38 is connected to the circulation pipe 29 by the injection pipe 41 having the injection pump 39 and a valve 40. The chemical tank 38 is filled with an oxalic acid aqueous solution.

The method of chemical decontamination for carbon steel member of a nuclear power plant according to the present embodiment using the chemical decontamination apparatus 28 will be explained based on the procedure shown in FIG. 1.

The chemical decontamination apparatus is connected to a piping of executing the chemical decontamination in the BWR plant (step S1). In the state that the operation of the BWR plant is stopped, as mentioned above, one end of the circulation pipe 29 of the chemical decontamination apparatus 28 is connected to the valve 26 installed on the purification system pipe 21 and another end of the circulation pipe 29 is connected to the valve 27 installed on the purification system pipe 21. In the state that the chemical decontamination apparatus 28 is connected to the purification system pipe 21, a closed loop including the circulation pipe 29 and the purification system pipe 21 is formed. A closed plug (not shown) is installed on the valve 26 on the side of the recirculation system pipe 4 so as to prevent the reduction decontaminating solution from flowing into the recirculation pipe 4. Furthermore, a closed plug (not shown) is installed on the side of the regeneration heat exchanger 23 so as to prevent the reduction decontaminating solution from flowing into the regeneration heat exchanger 23.

The temperature adjustment of circulation water is performed (step S2). The valves 35 and 40 are set in the closed state, and the open/close valves 48 and 51 and the valves 49, 50, 53 to 57, 59, and 60 are opened. Ion exchange water is supplied into the purification system pipe 21 between the valve 26 and the valve 27, the circulation pipe 29, the pipes 52, 55, and 58, the surge tank 31, the cation exchange resin column 42, the mix bed ion exchange resin column 43, the decomposition apparatus 44, and the circulation pumps 82 and 83 through the water feed pipe (not shown) connected to the circulation pipe 29 and those units are filled with the ion exchange water.

The open/close valves 48 and 51 and the valves 49 and 50 are kept opened, and the valves 53 to 57, 59, and 60 are closed, and the circulation pumps 82 and 83 are driven. The ion exchange water existing in the circulation pipe 29 and the surge tank 31 circulates in the closed loop including the circulation pipe 29 and the purification system pipe 21. An electric current is passed through the heater 61 and the ion exchange water in the surge tank 31 is heated by the heater 61. When the temperature of the water circulating in the closed loop rises to a preset temperature (for example, 90° C.) by heating by the heater 61, the heating of the circulating water by the heater 61 is stopped. The temperature of the ion exchange water circulating in the circulation pipe 29 and the purification system pipe 21 is adjusted to 90° C. which is a preset temperature by the heater 61.

The malonic acid is injected (step S3). The malonic acid aqueous solution is injected from the malonic acid injection apparatus 32 into the circulation pipe 29. Namely, the valve 35 is opened, and the injection pump 34 is driven. The malonic acid aqueous solution in the chemical tank 33 is injected into the ion exchange water flowing in the circulation pipe 29 through the injection pipe 36.

The oxalic acid is injected (step S4). The oxalic acid aqueous solution is injected from the oxalic acid injection apparatus 37 into the circulation pipe 29. Namely, the valve 40 is opened, and the injection pump 39 is driven. The oxalic acid aqueous solution in the chemical tank 38 is injected into the ion exchange water flowing in the circulation pipe 29 through the injection pipe 41. When the malonic acid aqueous solution injected from the malonic acid injection apparatus 32 reaches a connection point of the injection pipe 41 and the circulation pipe 29, the injection of the oxalic acid aqueous solution is performed. An aqueous solution including the malonic acid and the oxalic acid is generated in the circulation pipe 29.

The respective concentrations of the malonic acid and oxalic acid in the aqueous solution in the surge tank 31 are suitably measured by an ion chromatograph. When the oxalic acid concentration measured in the aqueous solution in the surge tank 31 becomes 400 ppm, the injection pump 39 is stopped and the valve 40 is closed. By doing this, the injection of the oxalic acid aqueous solution into the circulation pipe 29 is stopped. Also while the oxalic acid aqueous solution is injected, the malonic acid aqueous solution is injected. Though when the malonic acid concentration measured in the aqueous solution in the surge tank 31 becomes 5200 ppm, the injection pump 34 is stopped and the valve 35 is closed. By doing this, the injection of the malonic acid aqueous solution into the circulation pipe 29 is stopped.

In the injection of the malonic acid aqueous solution and oxalic acid aqueous solution into the circulation pipe 29, the malonic acid aqueous solution may be injected after the injection of the oxalic acid aqueous solution in place of the injection of the oxalic acid aqueous solution after the injection of the malonic acid aqueous solution. In this case, it is desirable to connect the oxalic acid injection apparatus 37 to the circulation pipe 29 so that it is positioned on the upstream side of the malonic acid injection apparatus 32.

By the injection of the malonic acid aqueous solution and oxalic acid aqueous solution into the ion exchange water flowing in the circulation pipe 29, a aqueous solution (reduction decontaminating solution) including the malonic acid with a concentration of 5200 ppm and the oxalic acid with a concentration of, for example, 400 ppm at 90° C. is generated in the surge tank 31.

The reduction decontamination is executed (step S5). The aqueous solution including the malonic acid of 5200 ppm and the oxalic acid of 400 ppm at 90° C., by driving the circulation pumps 82 and 83, is supplied into the purification system pipe 21 which is a carbon steel member of the BWR plant through the circulation pipe 29. When flowing in the purification system pipe 21, the aqueous solution including the malonic acid and oxalic acid makes contact with the inner surface of the purification system pipe 21. The oxide film formed on the inner surface of the purification system pipe 21 is dissolved more by the action of the oxalic acid included in the aqueous solution and part of the carbon steel member which is a base metal of the purification system pipe 21 is dissolved by the action of the malonic acid. Therefore, the radioactive nuclide included in the oxide film and the radioactive nuclide included in the base metal in the neighborhood of the inner surface of the purification system pipe 21 are eluted in the aqueous solution including the malonic acid and oxalic acid. The aqueous solution including the malonic acid and oxalic acid includes the ferrous ions and cations of the radioactive nuclide eluted from the oxide film and the base metal of the purification system pipe 21 and is discharged from the purification system pipe 21 into the circulation pipe 29. When the reduction decontamination is started (or when the malonic acid aqueous solution is injected) at step S5, the valves 53 and 54 are opened, and degree of opening of the valve 49 is reduced by adjusting the degree of the opening thereof. Part of the aqueous solution discharged from the purification system pipe 21 into the circulation pipe 29 is introduced to the cation exchange resin column 42. The ferrous ions and cations of the radioactive nuclide which are included in the aqueous solution including the malonic acid and oxalic acid are adsorbed to the cation exchange resin and removed in the cation exchange resin column 42.

A radiation detector (not shown) is installed in the neighborhood of a decontamination target area of the purification system pipe 21 wherein the reduction decontamination is executed, and the radiation discharged from the decontamination target area of the purification system pipe 21 is measured by the radiation detector. The dose rate in the reduction execution target area is obtained based on a radiation detection signal outputted from the radiation detector. While the aqueous solution including the malonic acid of 5200 ppm and the oxalic acid of 400 ppm at 90° C. circulates in the circulation pipe 29 and the purification system pipe 21, the reduction decontamination for the inner surface of the purification system pipe 21 is executed until the obtained dose rate reaches a preset dose rate (for example, 0.1 mSv/h) or lower and the ferrous ions eluted in the solution and cations of the radioactive nuclide are removed by the cation exchange resin column 42.

When the dose rate of the purification system pipe 21 in the decontamination target area becomes the preset dose rate (for example, 0.1 mSv/h) or lower or when a preset period of time (for example, 6 to 12 hours) elapses from the start of the reduction decontamination for the purification system pipe 21, the reduction decontamination for the purification system pipe 21 finishes.

The reduction decontamination agent is decomposed (step S6). When the reduction decontamination finishes, the valves 59 and 60 are opened, and agree of opening of the valve 50 is reduced. Part of the aqueous solution including the malonic acid and oxalic acid which is discharged from the purification system pipe 21 into the circulation pipe 29 is supplied to the decomposition apparatus 44. The malonic acid and oxalic acid are a reduction decontamination agent. By driving the feed pump 47, the hydrogen peroxide is supplied to the decomposition apparatus 44 from the medical fluid tank 46 through the oxidation agent feed pipe 48. The malonic acid and oxalic acid which are included in the aqueous solution are decomposed by the action of the hydrogen peroxide and activated carbon catalyst in the decomposition apparatus 44.

The malonic acid ($C_3H_4O_4$) is decomposed to carbon dioxide and water due to the reaction to the hydrogen peroxide shown in Formula (2). Further, the oxalic acid ($C_2H_2O_4$) is also decomposed to carbon dioxide and water due to the reaction to the hydrogen peroxide shown in Formula (3).

$$C_3H_4O_4+4H_2O_2=3CO_2+4H_2O \quad (2)$$

$$C_2H_2O_4+H_2O_2=2CO_2+2H_2O \quad (3)$$

Thus, when the malonic acid concentration is $C_{MA}$ and the oxalic acid concentration is $C_{OA}$, the reaction equivalent $C_{HP}$ of the hydrogen peroxide can be calculated based on Formula (4).

$$C_{HP}=(4\cdot C_{MA}/104+C_{OA}/90)\times 34 \quad (4)$$

Therefore, when the malonic acid concentration in the aforementioned aqueous solution including the malonic acid and oxalic acid is approx. 5200 ppm and the oxalic acid concentration is 400 ppm, the reaction equivalent of the hydrogen peroxide in the aqueous solution which is introduced into the decomposition apparatus 44, the reaction equivalent being calculated by Formula (4), becomes 6950 ppm. It is desirable to inject the hydrogen peroxide into the aqueous solution in the decomposition apparatus 44 so as to obtain a concentration about 1 to 2 times the reaction equivalent. Thus, when the malonic acid concentration in the aqueous solution including the malonic acid and oxalic acid which is introduced to the decomposition apparatus 44 is approx. 5200 ppm and the oxalic acid concentration is 400 ppm, hydrogen peroxide water is injected so as to control the hydrogen peroxide concentration in the aqueous solution to 6950 to 13900 ppm.

The decomposition process of the malonic acid and oxalic acid is continuously executed until the respective concentrations of the malonic acid and oxalic acid in the aqueous solution in the surge tank 31 which are measured by the ion chromatograph become their respective detection limit values (about 10 ppm). When the respective concentrations are reduced to the respective detection limits, the drive of the feed pump 47 is stopped, and the supply of the hydrogen peroxide to the decomposition apparatus 44 is stopped, and the valve 50 is opened fully, and the valves 59 and 60 are closed.

The reaction equivalent $C_{HP}$ of the hydrogen peroxide is obtained based on the respective measured values of the malonic acid concentration and oxalic acid concentration in the aqueous solution including the malonic acid and oxalic acid and the injection concentration of the hydrogen peroxide supplied to the decomposition apparatus 44 may be changed by the obtained reaction equivalent $C_{HP}$. By applying such a method, the quantity of the hydrogen peroxide supplied to the decomposition apparatus 44 can be more reduced than in the case that the hydrogen peroxide concentration supplied to the decomposition apparatus 44 is held at a predetermined concentration.

The purification process is executed (step S7). After completion of the decomposition process of the reduction decontamination agent (the malonic acid and oxalic acid), the applying power to the heater 61 installed in the surge tank 31 is stopped and then the cooling apparatus 30 is started. The valves 56 and 57 are opened, and the valves 53 and 54 are closed. In addition, the supply of the aqueous solution to the cation exchange resin column 42 is stopped. A cooling medium is supplied to the cooling apparatus 30 and the aqueous solution discharged from the purification system pipe 21 into the circulation pipe 29 is cooled by the cooling medium in the cooling apparatus 30. The solution is cooled by the cooling medium in the cooling apparatus 30 until it becomes a temperature (for example, room temperature) on a feedable level to the mix bed ion exchange resin column 43. The cooled solution is introduced to the mix bed ion exchange resin column 43. The anions included in the aqueous solution and the cations remaining without removed by the cation exchange resin column 42 are adsorbed to the anion exchange resin and cation exchange resin in the mix bed ion exchange resin column 43 and are removed. The aqueous solution is purified by the mix bed ion exchange resin column 43 while being cooled by the cooling apparatus 30 and circulating in the circulation pipe 29 and the purification system pipe 21. When the electric conductivity of the aqueous solution sampled from the surge tank 31 becomes 100 μS/m or lower, the valve 49 is opened and the valves 56 and 57 are closed. Furthermore, the circulation pumps 82 and 83 are stopped.

The chemical decontamination apparatus is detached from the piping for which the chemical decontamination of the BWR plant has been executed (step S8). A valve (not shown) installed on a water discharge pipe (not shown) connected to the circulation pipe 29 is opened and the water existing in the purification system pipe 21 between the valves 26 and 27, the circulation pipe 29, the pipes 52, 55, and 58, the surge tank 31, the cation exchange resin column 42, the mix bed ion exchange resin column 43, the decomposition apparatus 44, and the circulation pumps 82 and 83 is discharged into a storage tank (not shown) through the water discharge pipe. After completion of the water discharge, one end of the circulation pipe 29 is detached from the valve 26 installed on the purification system pipe 21 and another end of the circulation pipe 29 is detached from the valve 27 installed on the purification system pipe 21. After the chemical decontamination apparatus 28 is removed from the purification system pipe 21 which is a chemical decontamination object of the BWR plant, the BWR plant is restarted.

According to the present embodiment, the reduction decontamination for the inner surface of the purification system pipe 21 made of carbon steel is executed by using the aqueous solution (reduction decontaminating solution) including the malonic acid (for example, the concentration is 5200 ppm) and the oxalic acid of 400 ppm with a concentration within the range from 50 to 400 ppm, so that the oxide film formed on the inner surface of the purification system pipe 21 is dissolved furthermore by the action of the oxalic acid included in the aqueous solution and the carbon steel which is a base metal of the purification system pipe 21 is dissolved by the action of the malonic acid. The oxalic acid concentration included in the aqueous solution, that is, the reduction decontaminating solution including the malonic acid and oxalic acid is as low as 400 ppm, so that by performing the reduction decontamination for the inner surface of the purification system pipe 21 which is a carbon steel member by the reduction decontaminating solution, the deposition of the ferrous oxalate onto the oxide film formed on the inner surface of the purification system pipe 21 is suppressed and the dissolution of the oxide film by the oxalic acid can be performed efficiently. Furthermore, the carbon steel which is a base metal in the neighborhood of the inner surface of the purification system pipe 21 can be dissolved efficiently by the malonic acid. Therefore, the reduction decontamination efficiency for the inner surface of the purification system pipe 21 which is a carbon steel member can be improved, and the dose rate of the purification system pipe 21 can be reduced more. As a consequence, the exposure of an operator performing the maintenance inspection in the BWR plant can be reduced.

In the present embodiment for performing the reduction decontamination for the carbon steel member using the aqueous solution including the malonic acid and the oxalic acid with a concentration within the range from 50 to 400 ppm, the time required for the reduction decontamination in the present embodiment can be shortened than the chemical decontamination method described in Japanese Patent Laid-open No. 2003-90897 because there is no need to decompose the ferrous oxalate deposited on the surface of the carbon steel member in a time period which the reduction decontamination is performed, the ferrous oxalate being decomposed by a formic acid aqueous solution, after the reduction decontamination for the carbon steel member is performed using the oxalic acid aqueous solution, while this was needed in the chemical decontamination method described in Japanese Patent Laid-open No. 2003-90897.

Embodiment 2

Figure 10:
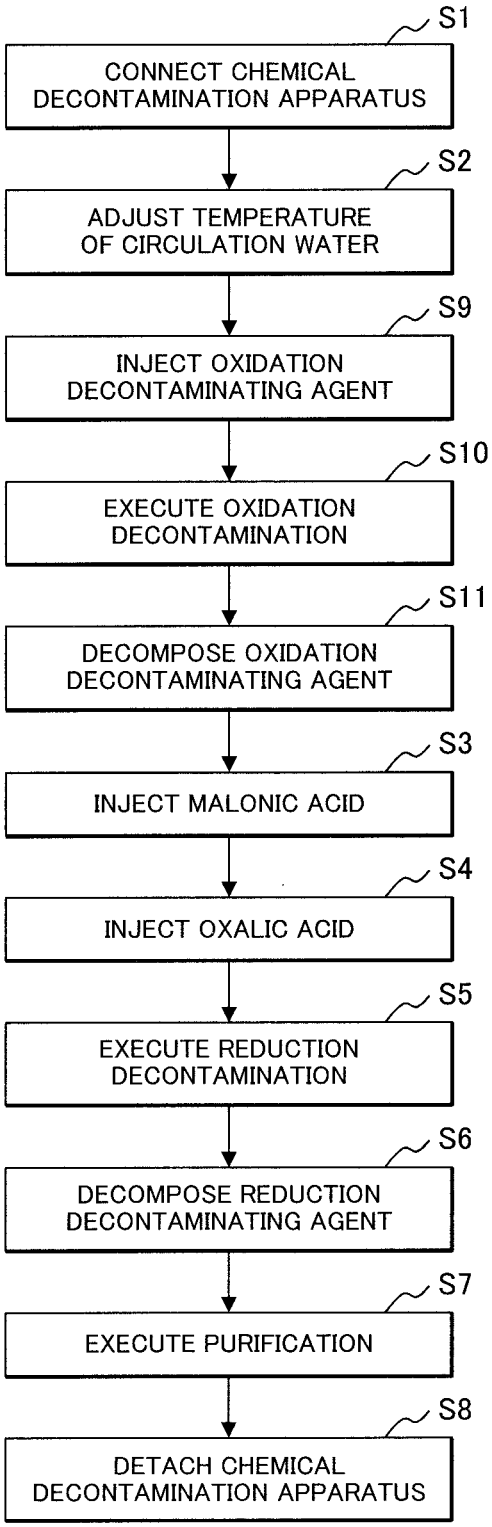
FIG. 10 is a flow chart showing processing procedure of a method of chemical decontamination for a carbon steel member of a nuclear power plant according to embodiment 2 which is another preferred embodiment of the present invention.
Figure 11:
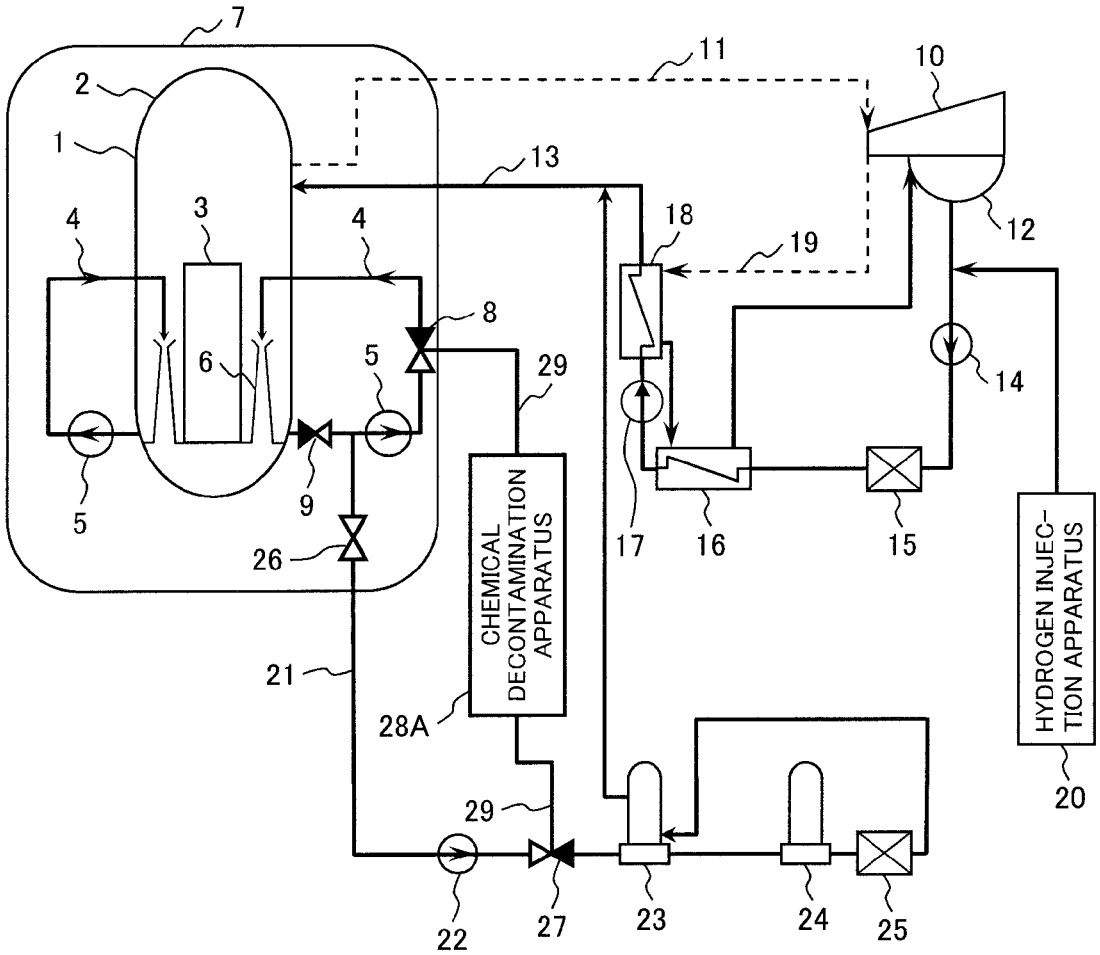
FIG. 11 is an explanatory drawing showing a connection state of a chemical decontamination apparatus to a boiling water nuclear power plant at execution time of a method of chemical decontamination for a carbon steel member of a nuclear power plant according to embodiment 2.
Figure 12:
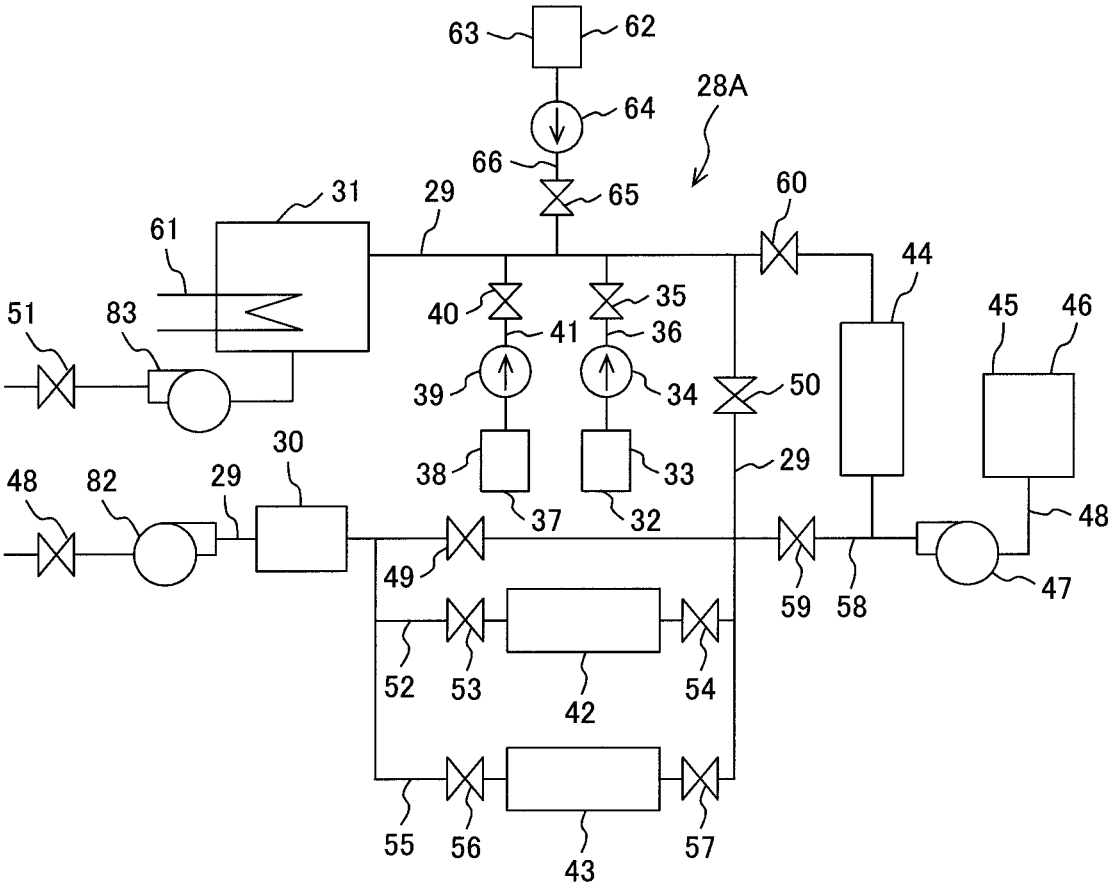
FIG. 12 is a detailed structural diagram showing a chemical decontamination apparatus shown in FIG. 11.

A method of chemical decontamination for a carbon steel member of a nuclear power plant according to embodiment 2 which is another preferred embodiment of the present invention will be explained by referring to FIGS. 10, 11, and 12. The method of chemical decontamination for the carbon steel member of the nuclear power plant according to the present embodiment is an example applied to a pipe (for example, the purification system pipe) made of a carbon steel and another pipe (for example, the recirculation system pipe) made of a stainless steel in the BWR plant. The chemical decontamination executed in the present embodiment includes oxidation decontamination and reduction decontamination.

A reduction decontamination apparatus 28A used in the method of chemical decontamination for a carbon steel member of a nuclear power plant according to the present embodiment will be explained by referring to FIG. 12. The reduction decontamination apparatus 28A has a structure in which an oxidation decontaminating solution injection apparatus 62 is added to the reduction decontamination apparatus 28 used in the method of chemical decontamination for the carbon steel member of the nuclear power plant according to embodiment 1. The oxidation decontaminating solution injection apparatus 62 includes a chemical tank 63, an injection pump 64, and an injection pipe 66. The chemical tank 63 is connected to the circulation pipe 29 by the injection pipe 66 having the injection pump 64 and a valve 65. The chemical tank 63 is filled with a potassium permanganate aqueous solution which is an oxidation decontaminating solution. A permanganate aqueous solution may be used as an oxidation decontaminating solution in place of the potassium permanganate aqueous solution.

The method of chemical decontamination for the carbon steel member of the nuclear power plant according to the present embodiment using the chemical decontamination apparatus 28A will be explained on the basis of the procedure shown in FIG. 10. In the procedure of the method of chemical decontamination for the carbon steel member of the nuclear power plant according to the present embodiment, the processes of steps S9 to S11 are added to the processes of steps S1 to S8 executed in the method of chemical decontamination for the carbon steel member of the nuclear power plant according to embodiment 1.

Firstly, the chemical decontamination apparatus is connected to a piping of executing the chemical decontamination in the BWR plant (step S1). In the state that the operation of the BWR plant is stopped, one end (the end on the side of the open/close valve 51) of the circulation pipe 29 of the chemical decontamination apparatus 28A is connected to the valve 8 installed on the recirculation system pipe 4 and another end (the end on the side of the open/close valve 48) of the circulation pipe 29 is connected to the valve 27 installed on the purification system pipe 21. In the state that the chemical decontamination apparatus 28A is connected to the recirculation system pipe 4 and the purification system pipe 21, a closed loop including the circulation pipe 29, the recirculation system pipe 4, and the purification system pipe 21 is formed. A closed plug (not shown) is installed on the valves 8 and 9 on the side of the RPV 2 so as to prevent the oxidation decontamination solution and reduction decontamination solution from flowing into the RPV 2. Furthermore, another closed plug (not shown) is installed on the side of the regeneration heat exchanger 23 so as to prevent the oxidation decontamination solution and reduction decontamination solution from flowing into the regeneration heat exchanger 23.

Similarly to embodiment 1, the circulation water temperature adjustment is performed (step S2). In step S2, similarly to embodiment 1, the circulation pipe 29, the recirculation system pipe 4 between the valves 8 and 9, and the purification system pipe 21 between the recirculation system pipe 4 and the valve 26 are internally filled with ion exchange water. In the present embodiment, injection of the potassium permanganate (step S9), oxidation decontamination (step S10) and decomposition of oxidation decontamination agent (step S11) are executed before injecting the malonic acid (step S3) and injecting the oxalic acid (step S4).

The oxidation decontamination agent is injected (step S9). In the present embodiment, the potassium permanganate is used as an oxidation decontamination agent. The potassium permanganate aqueous solution (the oxidation decontamination solution) is injected from the oxidation decontaminating solution injection apparatus 62 into the circulation pipe 29. Namely, when the valve 65 is opened and the injection pump 64 is driven, the potassium permanganate aqueous solution in the chemical tank 63 is injected into the ion exchange water flowing in the circulation pipe 29 through the injection pipe 66. The potassium permanganate aqueous solution injected into the ion exchange water is mixed with the ion exchange water in the surge tank 31 and becomes an oxidation decontamination solution. The mixed water of the potassium permanganate aqueous solution and the ion exchange water is referred to as the potassium permanganate aqueous solution (the oxidation decontamination solution) for the sake of convenience. The potassium permanganate aqueous solution is injected from the chemical tank 63 into the circulation pipe 29 so as to control the potassium permanganate concentration of the potassium permanganate aqueous solution which is generated by mixing with the ion exchange water, for example, to 300 ppm existing within a range from 200 to 500 ppm. It may be possible to use a permanganate as an oxidation decontamination agent and inject a permanganate aqueous solution from the chemical tank 63 into the circulation pipe 29.

The oxidation decontamination is executed (step S9). The potassium permanganate aqueous solution including the potassium permanganate of 300 ppm at 90° C. is supplied into the recirculation system pipe 4 which is a stainless steel member of the BWR plant through the circulation pipe 29 by driving the circulation pumps 82 and 83. When flowing in the recirculation system pipe 4, the potassium permanganate aqueous solution makes contact with the inner surface of the recirculation system pipe 4. A chromium oxide film formed on the inner surface of the recirculation system pipe 4 is dissolved by the action of the potassium permanganate included in the solution. Therefore, chromate ions included in the chromium oxide film and cations of the radioactive nuclide included in the chromium oxide film are eluted into the potassium permanganate aqueous solution in the recirculation system pipe 4. The potassium permanganate aqueous solution in the recirculation system pipe 4 flows from the recirculation system pipe 4 into the purification system pipe 21 made of carbon steel and soon is discharged into the circulation pipe 29. A ferrous oxide film is formed on the inner surface of the purification system pipe 21 made of carbon steel, though no chromium oxide film is formed. Even if the potassium permanganate aqueous solution flows in the purification system pipe 21, the potassium permanganate does not dissolve the ferrous oxide film formed on the inner surface formed on the inner surface of the purification system pipe 21. The potassium permanganate aqueous solution performs no oxidation decontamination for the inner surface of the purification system pipe 21, and flows in the purification system pipe 21, and is discharged into the circulation pipe 29.

The potassium permanganate aqueous solution executes the oxidation decontamination for the inner surface of the recirculation system pipe 4 while circulating in the circulation pipe 29, the recirculation system pipe 4, and the purification system pipe 21 for a predetermined period of time (for example, for 4 to 6 hours).

The oxidation decontamination agent is decomposed (step S11). The oxalic acid aqueous solution, similarly to Step S4 of Example 1, is injected into the potassium permanganate aqueous solution flowing in the circulation pipe 29 from the chemical tank 38. The injection of the oxalic acid aqueous solution into the circulation pipe 29 is performed similarly to the injection of the oxalic acid aqueous solution into the circulation pipe 29 in embodiment 1. After the injection of the oxalic acid aqueous solution, the potassium permanganate (oxidation decontamination agent) included in the potassium permanganate aqueous solution is decomposed by the injected oxalic acid (oxidation decontamination agent decomposition process). The decomposition of the potassium permanganate can be confirmed by monitoring color of the aqueous solution in the surge tank 31 by a monitoring camera through a glass window installed on the surge tank 31. The color of the potassium permanganate aqueous solution is purple and when the purple becomes transparent by the injection of the oxalic acid aqueous solution, the potassium permanganate is judged to have been decomposed. When the potassium permanganate is decomposed, the injection of the oxalic acid aqueous solution into the circulation pipe 29 is stopped, and furthermore, the valves 53 and 54 are opened, and by the opening angle adjustment, degree of opening of the valve 49 is reduced by adjustment of degree of the opening. Part of the aqueous solution discharged from the purification system pipe 21 into the circulation pipe 29 is introduced to the cation exchange resin column 42.

The processes at step S3 (injection of the malonic acid aqueous solution) and at step S4 (injection of the oxalic acid aqueous solution) are executed similarly to embodiment 1 and the reduction decontamination at step S5 is further executed. The reduction decontamination (step S5) is executed when the aqueous solution (reduction decontaminating solution) including the malonic acid of 5200 ppm and the oxalic acid of 100 ppm at 90° C. is supplied from the circulation pipe 29 into the recirculation system pipe 4 and furthermore, is introduced from the recirculation system pipe 4 to the purification system pipe 21. The reduction decontamination is performed for the respective inner surfaces of the recirculation system pipe 4 and the purification system pipe 21 in contact with the aqueous solution including the malonic acid of 5200 ppm and the oxalic acid of 100 ppm, by the act of the malonic acid and oxalic acid respectively, similarly to the reduction decontamination at step S5 of embodiment 1.

It is possible to connect the oxalic acid injection apparatus 37 to the circulation pipe 29 so as to position the oxalic acid injection apparatus 37 on the upstream side of the malonic acid injection apparatus 32, continuously perform the injection of the oxalic acid aqueous solution from the oxalic acid injection apparatus 37 into the circulation pipe 29 even after the oxidation decontamination agent decomposition process finishes (oxalic acid injection at step S4), and perform the injection of the malonic acid at step S3.

In the recirculation system pipe 4, the oxide film formed on the inner surface of the recirculation system pipe 4 is dissolved more by the action of the oxalic acid, and part of the stainless steel which is a base metal of the recirculation system pipe 41 is dissolved by the action of the malonic acid. Therefore, the radioactive nuclide included in the oxide film and the radioactive nuclide included in the base metal in the neighborhood of the inner surface of the recirculation system pipe 4 are eluted into the aqueous solution including the malonic acid and oxalic acid. Therefore, the aqueous solution including the malonic acid and oxalic acid flowing in the recirculation system pipe 4 includes the eluted ferrous ions and cations of the radioactive nuclide. Even in the purification system pipe 21, the ferrous ions and cations of the radioactive nuclide are eluted into the solution by the reduction decontamination by the malonic acid and oxalic acid, similarly to embodiment 1.

The aqueous solution including the ferrous ions and cations of the radioactive nuclide and including the malonic acid and oxalic acid is discharged from the purification system pipe 21 into the circulation pipe 29 and is introduced to the cation exchange resin column 42. The ferrous ions and cations of the radioactive nuclide are adsorbed to the cation exchange resin in the cation exchange resin column 42 and are removed.

While the aqueous solution including the malonic acid of 5200 ppm and the oxalic acid of 100 ppm is circulated in the closed loop including the circulation pipe 29, the recirculation system pipe 4, and the purification system pipe 21, the aqueous solution executes the reduction decontamination for the inner surfaces of the recirculation system pipe 4 and the purification system pipe 21. The ferrous ions and cations of the radioactive nuclide which are generated by the reduction decontamination are removed by the cation exchange resin column 42.

When the dose rate in each decontamination object area of the recirculation system pipe 4 and the purification system pipe 21 becomes a preset dose rate (for example, 0.1 mSv/h) or lower or when a preset period of time (for example, for 6 to 12 hours) elapses after the reduction decontamination is started, the reduction decontamination for the recirculation system pipe 4 and the purification system pipe 21 finishes.

Thereafter, the decomposition of the reduction decontamination agent (step S6), purification process (step S7), and the removal of the chemical decontamination apparatus (step S8) are executed successively, similarly to embodiment 1. After the chemical decontamination apparatus 28A is removed from the purification system pipe 21 which is a chemical decontamination target used in the BWR plant, the BWR plant is restarted.

The present embodiment can obtain each effect generated in embodiment 1. Furthermore, according to the present embodiment, the chemical decontamination can be performed simultaneously for the recirculation system pipe 4 made of stainless steel and the purification system pipe 21 made of carbon steel, so the time required for the chemical decontamination can be shortened. When the chemical decontamination is performed separately for the recirculation system pipe 4 and the purification system pipe 21 using the chemical decontamination apparatus 28A, the operation of the connection and removal of both the chemical decontamination apparatus 28 for the purification system pipe 21 and the chemical decontamination apparatus 28A for the recirculation system pipe 4 needs to be performed and furthermore, the circulation water temperature adjustment at step S2 needs to be performed both for the chemical decontamination apparatus 28 and for the chemical decontamination apparatus 28A. In the present embodiment simultaneously performing the chemical decontamination for the recirculation system pipe 4 and the purification system pipe 21 using the chemical decontamination apparatus 28A, the overlapped operations of the connection and removal of the chemical decontamination apparatuses 28 and 28A which are generated when the chemical decontamination is performed separately for the recirculation system pipe 4 and the purification system pipe 21 can be integrated into one. Therefore, according to the present embodiment, the time required for the chemical decontamination can be shortened.

It is possible to connect one end (the end on the side of the open/close valve 51) of the circulation pipe 29 of the chemical decontamination apparatus 28A to the valve 27 installed on the purification system pipe 21 and connect another end (the end on the side of the open/close valve 48) of the circulation pipe 29 to the valve 8 installed on the recirculation system pipe 4. In this case, in step S9 (oxidation decontamination), the potassium permanganate aqueous solution (oxidation decontaminating solution) is supplied from the circulation pipe 29 into the purification system pipe 21, is introduced from the purification system pipe 21 into the recirculation system pipe 4, and is discharged from the recirculation system pipe 4 into the circulation pipe 29. Further, in step S5 (reduction decontamination), the aqueous solution (reduction decontaminating solution) including the malonic acid of 5200 ppm and the oxalic acid of 100 ppm at 90° C. is also supplied from the circulation pipe 29 into the purification system pipe 21, is introduced from the purification system pipe 21 into the recirculation system pipe 4, and is discharged from the recirculation system pipe 4 into the circulation pipe 29. Even if the flowing direction of the oxidation decontaminating solution or reduction decontaminating solution is changed, the oxidation decontamination for the inner surface of the recirculation system pipe 4 or the reduction decontamination for the inner surfaces of the recirculation system pipe 4 and the purification system pipe 21 is performed.

Embodiment 3

Figure 13:
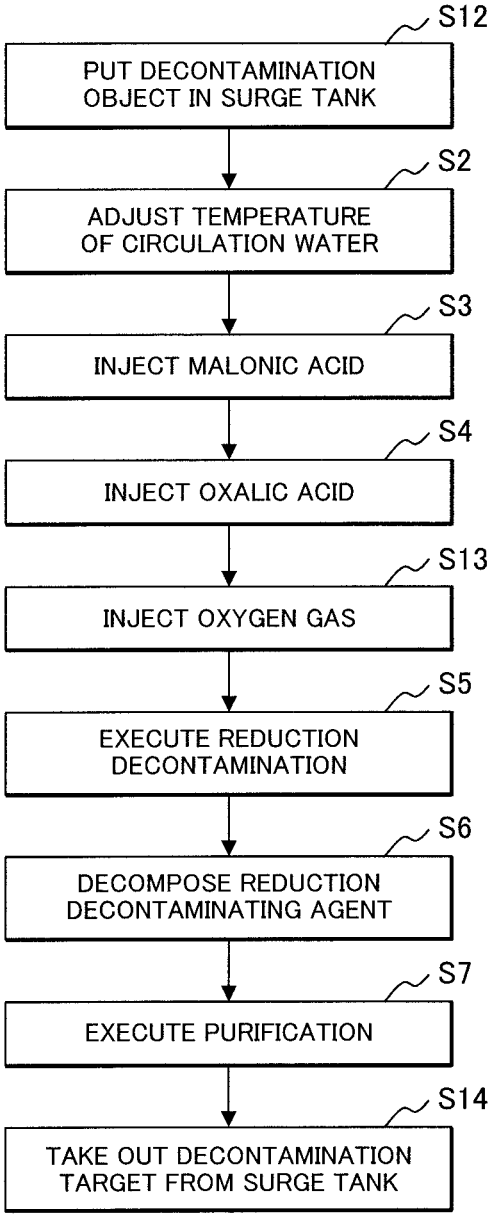
FIG. 13 is a flow chart showing processing procedure of a method of chemical decontamination for a carbon steel member of a nuclear power plant according to embodiment 3 which is other preferred embodiment of the present invention.
Figure 14:
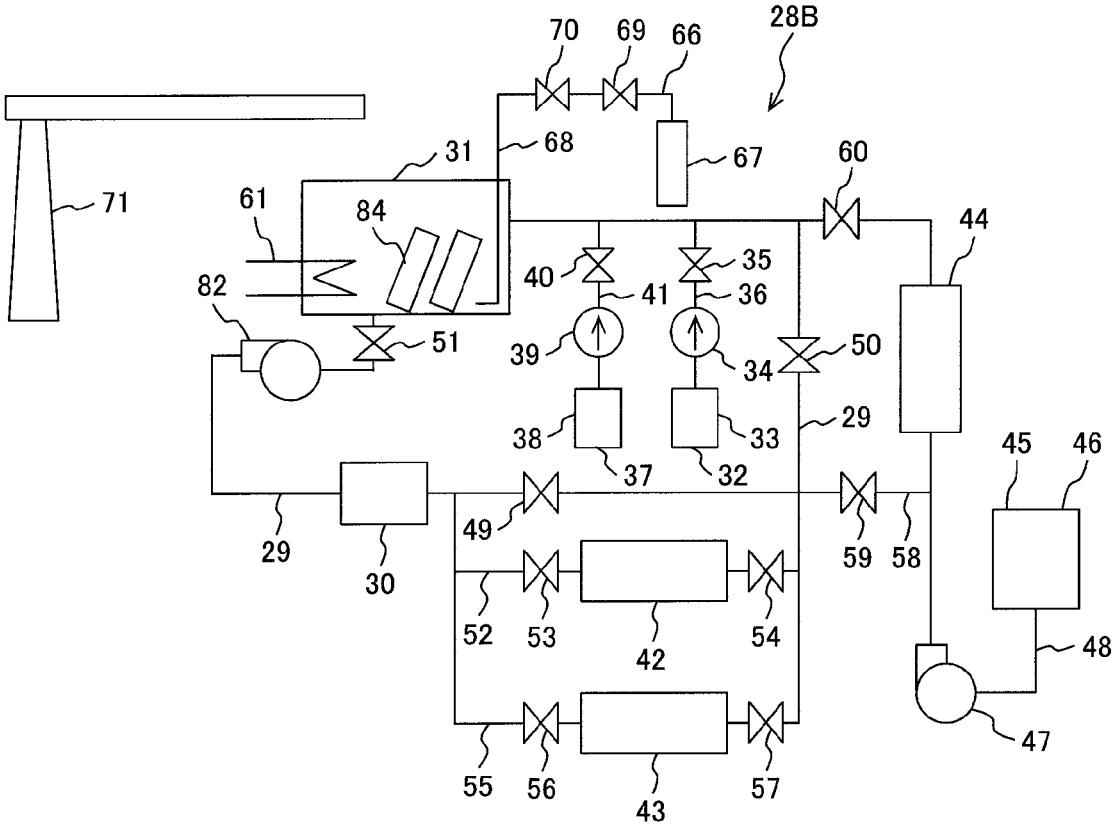
FIG. 14 is a structural diagram of a chemical decontamination apparatus used in a carbon steel member of a nuclear power plant according to embodiment 3.

A method of chemical decontamination for a carbon steel member of a nuclear power plant according to embodiment 3 which is other preferable embodiment of the present invention will be explained by referring to FIGS. 13 and 14. The method of chemical decontamination for the carbon steel member of the nuclear power plant according to the present embodiment is an example applied to a carbon steel member detached from the BWR plant by the exchange or decommissioning action, for example, a pipe made of carbon steel.

A chemical decontamination apparatus 28B used in the method of chemical decontamination for the carbon steel member of the nuclear power plant according to the present embodiment will be explained by referring to FIG. 13. The reduction decontamination apparatus 28B has a structure in which an oxygen gas feed apparatus 66 is added to the reduction decontamination apparatus 28 used in the method of chemical decontamination for the carbon steel member of the nuclear power plant according to embodiment 1; one end of the circulation pipe 29 is connected to the surge tank 31 in the reduction decontamination apparatus 28; and furthermore, the other end of the circulation pipe 29 is connected to the surge tank 31 to thereby form a closed loop including the circulation pipe 29 and the surge tank 31. The oxygen gas feed apparatus 66 includes an oxygen gas cylinder 67 and an oxygen gas feed pipe 68. One end portion of the oxygen gas feed pipe 68 is connected to the oxygen gas cylinder 67 and the other end of the oxygen gas feed pipe 68 is inserted into the surge tank 31. Many injection outlets (not shown) jetting oxygen gas are formed at the other end of the oxygen gas feed pipe 68 existing in the surge tank 31. An open/close valve 69 and a pressure reducing valve 70 are installed on the oxygen gas feed pipe 68 outside the surge tank 31. The other structure of the chemical decontamination apparatus 28B is the same as the chemical decontamination apparatus 28. Further, the chemical decontamination apparatus 28B has one circulation pump 82 installed on the circulation pipe 29 but no circulation pump 83.

The method of chemical decontamination for the carbon steel member of the nuclear power plant according to the present embodiment using the chemical decontamination apparatus 28B will be explained based on the procedure shown in FIG. 13. In the method of chemical decontamination for the carbon steel member according to the present embodiment, each process at steps S12 and S14 is performed respectively in place of each process at steps S1 and S8 in the procedure of the method of chemical decontamination for the carbon steel member according to embodiment 1 and furthermore, the procedure with the process at step S13 added is executed. Each process at steps S2 to S4 and S5 to S7 which is executed by the method of chemical decontamination according to the present embodiment is the same as each process executed by the method of chemical decontamination according to embodiment 1.

The decontamination target is put in the decontamination bath (step S12). The surge tank 31 also has a function of the decontamination bath. To exchange with a new pipe made of carbon steel, a pipe 84 which is a decontamination object detached from the BWR plant, the pipe being made of carbon steel, is transferred to the position of the surge tank 31 by transport equipment 71 and is put in the surge tank 31 with the upper end opened. The pipes made of carbon steel and the equipment made of carbon steel other than the pipe 84 removed from the BWR plant are put in the surge tank 31 by the transport equipment 71. After a plurality of decontamination objects are put in the surge tank 31, the surge tank 31 is attached with a cover and the surge tank 31 is sealed up.

The circulation water temperature adjustment (step S2), the malonic acid injection (step S3), and the oxalic acid injection (step S4) are performed similarly to embodiment 1. Each process at steps S3 and S4 is executed, thus the aqueous solution including the malonic acid of 12300 ppm and the oxalic acid of 100 ppm at 90° C. is generated in the surge tank 31. In the present embodiment, it is desirable to remove the radioactive nuclide from the decontamination object, such as the pipe 84, put in the surge tank 31. Therefore, there is no need to consider damage of the equipment installed in the BWR plant as far as possible and as in embodiments 1 and 2, so that in the injection of the malonic acid aqueous solution into the circulation pipe 29 at step S3, it is desirable to control the malonic acid concentration generated in the surge tank 31 so as to reduce the pH of the solution to 1.8 or lower. Thus, the malonic acid aqueous solution is injected into the circulation pipe 29 from the malonic acid injection apparatus 32 so as to control the malonic acid concentration, for example, to 12300 ppm. When the malonic acid concentration of the aqueous solution becomes 12300 ppm, the injection of the malonic acid aqueous solution into the circulation pipe 29 is stopped. Further, when the oxalic acid concentration of the aqueous solution becomes 100 ppm, the injection of the oxalic acid aqueous solution into the circulation pipe 29 is stopped.

Oxygen gas is injected (step S13). The oxygen gas in the oxygen gas cylinder 67 is introduced through the oxygen gas feed pipe 68 by opening the open/close valve 69 and is jetted into the aqueous solution including the malonic acid of 12300 ppm and the oxalic acid of 100 ppm at 90° C. in the surge tank 31 from the plurality of injection outlets formed at the end portion of the oxygen gas feed pipe 68 existing in the surge tank 31. Degree of opening of the pressure reducing valve 70 is adjusted so as to control the oxygen gas pressure jetted from each injection outlet of the oxygen gas feed pipe 68 to within the range from 0.1 to 1.0 MPa. In the present embodiment, the degree of opening of the pressure reducing valve 70 is adjusted so as to control the jet pressure of oxygen gas to, for example, 0.5 MPa. The injected oxygen gas is dissolved by the aqueous solution including the malonic acid and oxalic acid.

In the reduction decontamination (step S5), the aqueous solution including the malonic acid of 12300 ppm, the oxalic acid of 100 ppm, and oxygen at 90° C. makes contact with each surface of the pipes 84 in the surge tank 31 and the reduction decontamination for the pipes 84 is performed. Since the circulation pump 82 is being driven, the aqueous solution in the surge tank 31 is discharged from the surge tank 31 into the circulation pipe 29, circulates once in the circulation pipe 29 forming the closed loop, and is returned into the surge tank 31.

The valves 53 and 54 are opened and degree of opening of the valve 49 is reduced by adjustment of the degree of opening thereof. Part of the aqueous solution discharged from the surge tank 31 into the circulation pipe 29 is introduced to the cation exchange resin column 42. The ferrous oxide formed on the surface of the pipes 84 is dissolved by the reduction decontamination for the pipe 84 by the aqueous solution including the malonic acid of 12300 ppm, the oxalic acid of 100 ppm, and oxygen at 90° C., similarly to embodiment 1 and part of the carbon steel which is a base metal of each pipe 84 is dissolved. Similarly to embodiment 1, the ferrous ions and cations of the radioactive nuclide are eluted into the aqueous solution in the surge tank 31. The ferrous ions and cations of the radioactive nuclide included in the aqueous solution introduced to the cation exchange resin column 42 are adsorbed to the cation exchange resin in the cation exchange resin column 42 and are removed. The aqueous solution including the malonic acid of 12300 ppm, the oxalic acid of 100 ppm, and oxygen at 90° C. passes through the cation exchange resin column 42 while circulating in the surge tank 31 and the circulation pipe 29. The reduction decontamination for the pipes 84 in the surge tank 31 is performed by the circulating aqueous solution. The injection of oxygen gas into the aqueous solution including the malonic acid and oxalic acid in the surge tank 31 by the oxygen gas feeder 66 is performed continuously while the reduction decontamination for the pipes 84 is performed.

When the dose rate of the pipe 84 obtained based on the radiation detection signal outputted from a radiation detector disposed in the neighborhood of the surge tank 31 becomes the preset dose rate (for example, 0.1 mSv/h) or lower or when a preset period of time (for example, for 6 to 12 hours) from the start of the reduction decontamination elapses, the reduction decontamination for the pipe 84 finishes.

After completion of the reduction decontamination, the decomposition of the reduction decontamination agent (step S6) and the purification process (step S7) are performed, similarly to embodiment 1, while the aqueous solution is permitted to circulate in the surge tank 31 and the circulation pipe 29. After completion of the purification process, the decontamination object is taken out (step S14) from the decontamination bath. The surge tank 31 which is a decontamination bath is opened, and the pipes 84 with the reduction decontamination finished are taken out from the surge tank 31 using the transport equipment 71.

After the pipes 84 with the reduction decontamination finished are taken out, the reduction decontamination for a new chemical decontamination objects are executed by repeating steps S12, S2 to S4, S13, S5 to S7, and S14.

The present embodiment can obtain each effect generated in embodiment 1. Furthermore, the present embodiment can perform the reduction decontamination even for the carbon steel members taken out from the nuclear power plant.

Further, in the present embodiment, it is possible to execute the reduction decontamination for the pipes 84 in the surge tank 31 without injecting oxygen gas into the aqueous solution including the malonic acid of 12300 ppm and the oxalic acid of 100 ppm at 90° C. and by permitting the solution with no oxygen gas injected to circulate in the surge tank 31 with the pipes 84 put and the circulation pipe 29.

In cases where many carbon steel members (for example, the pipes 84) require reduction decontamination like decommissioning and remodeling of the BWR plant, the reduction decontamination for individual carbon steel members is performed as described below using the chemical decontamination apparatus 28B. In Step S12, the pipes 84 are put in the surge tank 31 and each process at steps S2 to S4, S13, and S5 is executed successively. When the reduction decontamination process at step S5 finishes, taking out the decontamination object from the surge tank 31 (step S14) is executed. A plurality of pipes 84 with the reduction decontamination finished are taken out from the surge tank 31 by the transport equipment 71 and is transferred to a washing apparatus 72 (refer to FIG. 15) installed separately from the chemical decontamination apparatus 28B. These pipes 84 are washed by the washing apparatus 72.

Figure 15:
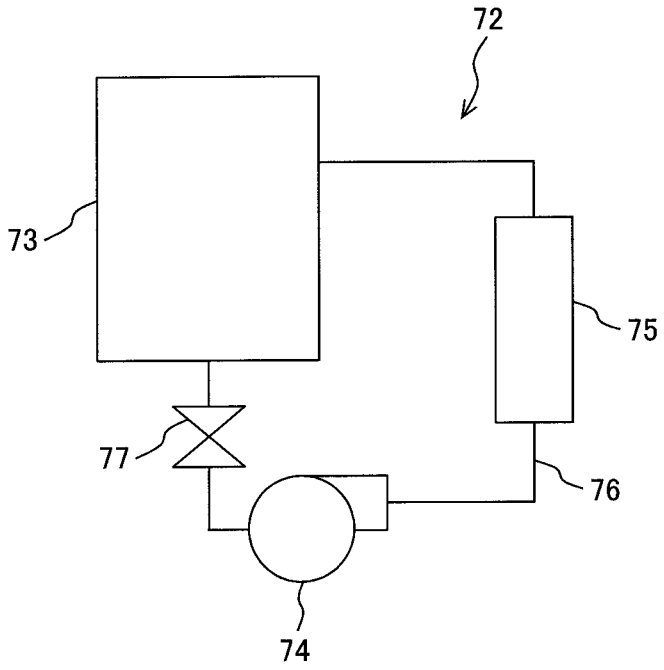
FIG. 15 is a structural diagram of a washing apparatus for washing a decontamination object which is used a carbon steel member of a nuclear power plant according to embodiment 3.

A structure of the washing apparatus 72 will be explained below by referring to FIG. 15. The washing apparatus 72 includes a washing bath 73, a circulation pump 74, and a mix bed ion exchange resin column 75. One end portion of a circulation pipe 76 is connected to the washing bath 73 and another end portion of the circulation pipe 76 is also connected to the washing bath 73. A closed loop is formed by the washing bath 73 and the circulation pipe 76. The circulation pump 74 and the mix bed ion exchange resin column 75 are installed on the circulation pipe 76. The mix bed ion exchange resin column 75 is internally filled with the cation exchange resin and anion exchange resin.

The pipes 84 taken out from the surge tank 31 and transferred by the transport equipment 71 are taken off the cap from upper end and are put in the washing bath 73, from an upper end of which a cap is taken off and which is filled with the washing water. After the plurality of pipes 84 reduction-decontaminated are put in the washing bath 73, the cap is attached to the upper end of the washing bath 73, and the washing bath 73 is sealed up. The circulation pump 74 is driven and the washing water in the washing bath 73 is circulated through the circulation pipe 76 and the mix bed ion exchange resin column 75. The pipes 84 in the washing bath 73 are washed by the circulating washing water. The radioactive nuclide adhered to the pipes 84 moves from the pipes 84 to the washing water, and is adsorbed to the ion exchange resin in the mix bed ion exchange resin column 75, and is removed from the washing water. When the dose rate of the pipes 84 in the washing bath 73 becomes the preset dose rate (for example, 0.1 mSv/h) or lower, the washing for the pipes 84 in the washing bath 73 finishes. The pipes 84 which have been washed and become the preset dose rate or lower are taken out from the washing apparatus 73.

A plurality of pipes 84 to be newly reduction-decontaminated are put in the surge tank 31 of the chemical decontamination apparatus 28B from which the reduction-decontaminated pipes 84 have been taken out (step S12). Each process at Steps S12, S2 to S4, S13, and S5 is executed using the chemical decontamination apparatus 28B and the reduction decontamination is executed for the pipes 84 in the surge tank 31. After completion of the reduction decontamination at Step S5, as mentioned above, the plurality of pipes 84 for which the reduction decontamination has been executed are taken out from the surge tank 31. These pipes 84 are washed by the washing apparatus 72. A new plurality of pipes 84 to be reduction-decontaminated are put in the surge tank 31 and as mentioned above, the reduction decontamination is executed for these pipes 84. The reduction decontamination in the surge tank 31 is performed continuously until the pipes 84 which are a reduction decontamination object are exhausted. The aqueous solution (reduction decontaminating solution) including the malonic acid of 12300 ppm and the oxalic acid of 100 ppm which exists in the surge tank 31 and the circulation pipe 29 is reused when the reduction decontamination is performed for the new pipes 84 in the surge tank 31. After the reduction decontamination (step S5) for the last plurality of pipes 84 in the surge tank 31 finishes, the decomposition of the reduction decontaminating agent (step S6) and the purification process (step S7) are executed successively with those pipes 84 put in the surge tank 31 and furthermore, the take-out of the decontamination objects (step S14) are executed.

The washing of the reduction-decontaminated pipes 84 taken out from the surge tank 31 is performed using the washing apparatus 72, so that when there are many decontamination objects subject to the reduction decontamination, there is no need to perform the decomposition of the reduction decontaminating agent (step S6) and the purification process (Step S7) whenever the reduction decontamination in the surge tank 31 finishes, enabling efficient reduction decontamination for the washing object. Therefore, the time required for the reduction decontamination when there are many decontamination objects subject to the reduction decontamination can be shortened. Further, the malonic acid and oxalic acid included in the reduction decontaminating solution are not decomposed whenever the reduction decontamination finishes, so that the reduction decontaminating solution including the malonic acid and oxalic acid can be reused.

Figure 16:
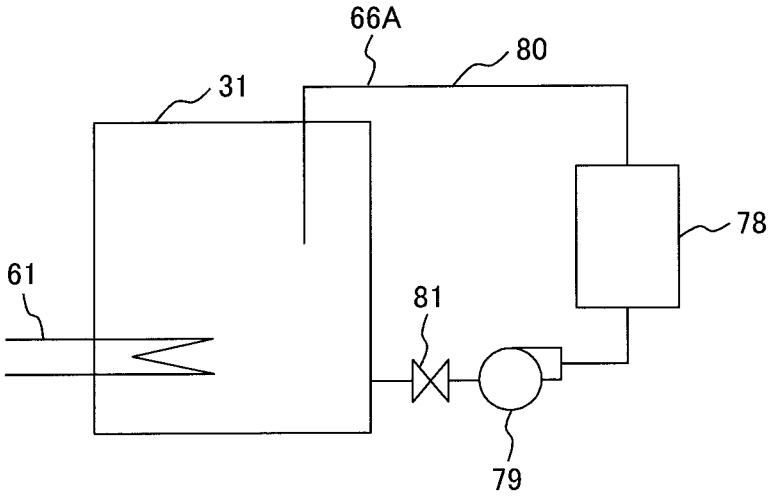
FIG. 16 is a structural diagram showing another embodiment of an oxygen gas supply apparatus used in a chemical decontamination apparatus shown in FIG. 14.

The oxygen gas feed apparatus 66 used in the reduction decontamination apparatus 28B may be changed to an oxygen gas feed apparatus 66A shown in FIG. 16. In the oxygen gas feed apparatus 66A, a circulation pump 79 and a micro-bubble generator 78 are installed on a pipe 80 with one end portion thereof connected to the bottom of the surge tank 31. Another end portion of the pipe 80 is inserted into the surge tank 31.

A valve 81 is opened and the circulation pump 79 is driven. The aqueous solution including the malonic acid of 12300 ppm and the oxalic acid of 100 ppm at 90° C. in the surge tank 31 is supplied to the micro-bubble generator 78 through the pipe 80. The micro-bubble generator 78 supplies oxygen-included gas of a micron order (for example, air) to the aqueous solution. The aqueous solution including the oxygen-included gas of a micron order (micro bubbles) is injected into the aqueous solution in the surge tank 31 through the pipe 80. Therefore, the aqueous solution including the malonic acid of 12300 ppm, the oxalic acid of 100 ppm at 90° C., and the oxygen-included gas of a micron order makes contact with the pipes 84 in the surge tank 31. In the oxygen-included gas of a micron order, the contact solution area for the bubble volume is large, so that the oxygen included in the oxygen-included gas of a micron order is dissolved easily in the aqueous solution in the surge tank 31. Thus, the reduction decontamination effects can be improved by a small quantity of the oxygen-included gas.

The oxygen gas feed apparatus 66 or 66A can be applied to the chemical decontamination apparatuses 28 and 28A. Therefore, even in embodiments 1 and 2, the reduction decontamination can be executed for the purification system pipe 21 and the recirculation system pipe 4 using the aqueous solution including the malonic acid, oxalic acid, and oxygen. In each of embodiments 1 to 3, oxygen gas or oxygen-included gas of a micron order is injected into the water which is a reduction decontaminating solution in the surge tank 31, so that the dissolution of oxygen into the aqueous solution is performed easily compared with the case that the oxygen gas or oxygen-included gas of a micron order is injected into the circulation pipe 29.

REFERENCE SIGNS LIST

2: reactor pressure vessel, 4: primary loop recirculation system piping, 5: recirculation pump, 10: turbine, 13: water feed pipe, 21: purification system pipe, 28, 28A, 28B: chemical decontamination apparatus, 31: surge tank, 32: malonic acid injection apparatus, 33, 38, 46, 63: chemical tank, 34, 39, 64: injection pump, 37: oxalic acid injection apparatus, 42: cation exchange resin column, 43, 75: mix bed ion exchange resin column, 45: oxidation agent supply apparatus, 62: oxidation decontaminating solution injection apparatus, 66, 66A: oxygen gas feed apparatus, 78: micro-bubble generator.

What is claimed is:

1. A method of chemical decontamination for a carbon steel member of a nuclear power plant, comprising steps of:

bringing a reduction decontaminating solution including a malonic acid and an oxalic acid within a range from 50 to 400 ppm into contact with a surface of a carbon steel member of a nuclear power plant; and executing reduction decontamination for the surface of the carbon steel member by the reduction decontaminating solution.

2. The method of chemical decontamination for a carbon steel member of a nuclear power plant according to claim 1, comprising step of:

removing cations eluted from the carbon steel member into the reduction decontaminating solution by the reduction decontamination, from the reduction decontaminating solution.

3. The method of chemical decontamination for a carbon steel member of a nuclear power plant according to claim 1, comprising step of:

injecting oxygen gas into the reduction decontaminating solution including the malonic acid and the oxalic acid within the range from 50 to 400 ppm, wherein the reduction decontamination for the surface of the carbon steel member is performed by using the reduction decontaminating solution including the malonic acid and the oxalic acid within the range from 50 to 400 ppm with the injected oxygen gas.

4. The method of chemical decontamination for a carbon steel member of a nuclear power plant according to claim 3, wherein the oxygen gas is micro bubbles generated by a micro-bubble generation apparatus.

5. The method of chemical decontamination for a carbon steel member of a nuclear power plant according to claim 1, wherein a malonic acid concentration of the reduction decontaminating solution is within a range from 2100 to 19000 ppm.

6. The method of chemical decontamination for a carbon steel member of a nuclear power plant according to claim 5, wherein the malonic acid concentration is within a range from 2100 to 7800 ppm.

7. The method of chemical decontamination for a carbon steel member of a nuclear power plant according to claim 1, comprising steps of:

putting the carbon steel member detached from the nuclear power plant in a decontamination vessel; and supplying the reduction decontaminating solution into the decontamination vessel, wherein the reduction decontamination for the surface of the carbon steel member is performed by bringing the reduction decontaminating solution into contact with the carbon steel member in the decontamination vessel.

8. The method of chemical decontamination for a carbon steel member of a nuclear power plant according to claim 7, wherein a concentration of the malonic acid of the reduction decontaminating solution is within a range from 12300 to 19000 ppm.

9. A method of chemical decontamination for a carbon steel member of a nuclear power plant, comprising steps of:

connecting a second pipe to a first pipe, which is made of carbon steel, of the nuclear power plant; and supplying a reduction decontaminating solution including a malonic acid and an oxalic acid within a range from 50 to 400 ppm to the first pipe through the second pipe, wherein reduction decontamination for an inner surface of the first pipe is performed by bringing the reduction decontaminating solution into contact with the inner surface.

10. The method of chemical decontamination for a carbon steel member of a nuclear power plant according to claim 9, comprising step of:

removing cations eluted from the first pipe into the reduction decontaminating solution by the reduction decontamination, from the reduction decontaminating solution.

11. The method of chemical decontamination for a carbon steel member of a nuclear power plant according to claim 9, comprising steps of:

forming a closed loop including a first pipe, a second pipe, and a third pipe by connecting one end portion the second pipe to the first pipe and by connecting another end portion of the second pipe to the third pipe made of stainless steel and connected to the first pipe;

supplying an oxidation decontaminating solution injected from an oxidation decontaminating solution injection apparatus connected to the second pipe into the third pipe through the second pipe;

performing oxidation decontamination for an inner surface of the third pipe by the oxidation decontaminating solution; and performing the reduction decontamination for the inner surface of the third pipe by the reduction decontaminating solution supplied to the third pipe through the second pipe as well as performing reduction decontamination for an inner surface of the first pipe.

12. The method of chemical decontamination for a carbon steel member of a nuclear power plant according to claim 11, wherein the reduction decontaminating solution is generated by the malonic acid injected from a malonic acid injection apparatus connected to the second pipe into the second pipe and the oxalic acid injected from an oxalic acid injection apparatus connected to the second pipe into the second pipe.

13. A method of chemical decontamination for a carbon steel member of a nuclear power plant, comprising steps of:

injecting oxygen gas into a reduction decontaminating solution including a malonic acid and an oxalic acid;

bringing the reduction decontaminating solution including the malonic acid and the oxalic acid with the injected oxygen gas into contact with a surface of the carbon steel member of the nuclear power plant; and performing reduction decontamination for the surface of the carbon steel member by the reduction decontaminating solution brought into contact with the surface of the carbon steel member.

14. The method of chemical decontamination for a carbon steel member of a nuclear power plant according to claim 13, comprising steps of:

putting the carbon steel member detached from the nuclear power plant in a decontamination vessel;

supplying the reduction decontaminating solution including the malonic acid and the oxalic acid into the decontamination vessel; and injecting the oxygen gas into the reduction decontaminating solution in the decontamination vessel, wherein the reduction decontamination for the surface of the carbon steel member is performed in the decontamination vessel by bringing the reduction decontaminating solution including the malonic acid and the oxalic acid with the injected oxygen gas into contact with the carbon steel member.

* * * * *